US010967403B2

(12) United States Patent
Neumann

(10) Patent No.: US 10,967,403 B2
(45) Date of Patent: Apr. 6, 2021

(54) SCREENING APPARATUS

(71) Applicant: Bruce Neumann, Queensland (AU)

(72) Inventor: Bruce Neumann, Queensland (AU)

( * ) Notice: Subject to any disclaimer, the term of this patent is extended or adjusted under 35 U.S.C. 154(b) by 0 days.

(21) Appl. No.: 16/081,221

(22) PCT Filed: Apr. 3, 2017

(86) PCT No.: PCT/AU2017/050284

§ 371 (c)(1),
(2) Date: Aug. 30, 2018

(87) PCT Pub. No.: WO2017/173482

PCT Pub. Date: Oct. 12, 2017

(65) Prior Publication Data

US 2019/0091727 A1 Mar. 28, 2019

(30) Foreign Application Priority Data

Apr. 3, 2016 (AU) ..... 2016901227

(51) Int. Cl.
*B07B 13/18* (2006.01)
*B07B 1/28* (2006.01)
(Continued)

(52) U.S. Cl.
CPC ..... *B07B 13/18* (2013.01); *B07B 1/28* (2013.01); *B07B 1/36* (2013.01); *B07B 1/46* (2013.01);
(Continued)

(58) Field of Classification Search
CPC .... B07B 1/28; B07B 1/36; B07B 1/46; B07B 13/08; B07B 13/16; B07B 13/18
(Continued)

(56) References Cited

U.S. PATENT DOCUMENTS 6,073,979 A * 6/2000 Nawalaniec ..... B07B 1/46 209/372
2007/0245839 A1* 10/2007 Rieberer ..... E21B 49/005 73/863.23
(Continued)

FOREIGN PATENT DOCUMENTS

EP 0094741 B1 2/1990
GB 2458977 A * 10/2009
GB 2458977 A 10/2009

OTHER PUBLICATIONS

International Search Report for PCT/AU2017/050284 dated May 9, 2017.

*Primary Examiner* — Terrell H Matthews
(74) *Attorney, Agent, or Firm* — Caeser Rivise, PC

(57) ABSTRACT

A screening apparatus includes a vibrating screen assembly that includes a screen and a vibrating mechanism operable on the screen to cause vibration of the screen, the screen having a feed end and a discharge end. At least one shield member is positioned on the screen and is configured to cover part of the screen between the feed end of the screen and a position intermediate the feed and discharge ends of the screen, such that particulate material for screening by the screen can be fed on to the, or each, shield member, the, or each shield member being positioned on the screen so that a vibrational pattern of the screen is imparted to the shield member. An adjustment mechanism is operatively engaged with the, or each, shield member to adjust a position of a discharge end of the, or each, shield member relative to the discharge end of the screen.

35 Claims, 23 Drawing Sheets

(51) Int. Cl.

| | |
|---|---|
| ***B07B 1/46*** | (2006.01) |
| ***B07B 13/16*** | (2006.01) |
| ***B65H 75/28*** | (2006.01) |
| ***B07B 1/36*** | (2006.01) |
| ***B07B 13/08*** | (2006.01) |

(52) U.S. Cl.
CPC ..... *B07B 13/08* (2013.01); *B07B 13/16* (2013.01); *B65H 75/28* (2013.01)

(58) Field of Classification Search
USPC ..... 209/236
See application file for complete search history.

(56) References Cited

U.S. PATENT DOCUMENTS

| | | | | |
|---|---|---|---|---|
| 2009/0134073 | A1* | 5/2009 | Campe | B07B 13/05 209/660 |
| 2010/0018909 | A1* | 1/2010 | Smith | B01D 33/0376 209/269 |
| 2019/0091727 | A1* | 3/2019 | Neumann | B65H 75/28 |

* cited by examiner

SCREENING APPARATUS

CROSS REFERENCE TO RELATED APPLICATIONS

This United States national phase application claims the benefit under 35 U.S.C. § 371 of PCT Application No. PCT/AU2017/050284 filed on Apr. 3, 2017, which in turn claims the benefit of Australian Application Serial No. 2016901227 filed on Apr. 3, 2016 and all of whose entire disclosures are incorporated by reference herein.

FIELD OF THE INVENTION

Various embodiments of a screening apparatus, an accessory for the screening apparatus, a system including the screening apparatus, and a method of screening are described in this specification.

SUMMARY OF THE INVENTION

In one aspect, there is provided a screening apparatus that comprises:

a vibrating screen assembly that includes a screen and a vibrating mechanism operable on the screen to cause vibration of the screen, the screen having a feed end and a discharge end;

at least one shield member positioned on the screen and configured to cover part of the screen between the feed end of the screen and a position intermediate the feed and discharge ends of the screen, such that particulate material for screening by the screen can be fed on to the, or each, shield member, the, or each shield member being positioned on the screen so that a vibrational pattern of the screen is imparted to the shield member; and an adjustment mechanism operatively engaged with the, or each, shield member to adjust a position of a discharge end of the, or each, shield member relative to the discharge end of the screen.

The shield member may be configured so that the vibrational pattern imparted to the, or each, shield member is imparted to a layer of the particulate material on the, or each, shield member to encourage stratification of the particulate material prior to the particulate material being fed onto the screen from the discharge end of the, or each, shield member.

The, or each, shield member may be in the form of a length of resilient material.

The, or each, shield member may be fed from a roller assembly.

The, or each, shield member may be articulated and may include lengths of shield sections that are pivotal with respect to each other.

The, or each, shield member may be of an elastomeric material.

The adjustment mechanism may include a pair of opposed rollers that engage opposite sides of the, or each, shield member, at least one of the rollers being a driven roller.

The screening apparatus may include a control arrangement that controls the adjustment mechanism.

The control arrangement may be configured to permit direct control of an extent of adjustment of the relative positions of the discharge ends of the, or each, shield member and screen, respectively.

The control arrangement may include an infeed sensing arrangement for sensing an infeed rate of particulate material onto the shield member and an outfeed sensing arrangement for sensing at least one of an outfeed rate of screenings and an outfeed rate of discharge from the screen.

The control arrangement may include a data processing apparatus that is configured to receive signals from the sensing arrangements and to generate suitable output signals for the adjustment mechanism so that the adjustment mechanism can be controlled automatically to adjust a particle size distribution of at least one of the discharge and the screenings.

The sensing arrangements may include weigh-in-motion devices, one of which is positioned upstream of the screen and at least one other positioned to receive either the discharge or the screenings.

The sensing arrangements may include at least one sensor that is operatively arranged with respect to the screen to sense at least one of particle size distribution within particulate material fed to the shield member, particle size distribution within screenings and particle size distribution within discharge.

The screen may have apertures which are all generally of the same size.

The screen may have different zones between the feed end and the discharge end of the screen, each zone having apertures of a different size to the apertures of an adjacent zone.

In another aspect, there is provided an accessory for a screening apparatus, the accessory comprising:

at least one shield member that is configured to be positioned on a vibrating screen of the screening apparatus to cover part of the screen between a feed end of the screen and a position intermediate the feed end and a discharge end of the screen such that particulate material for screening by the screen can be fed onto the, or each, shield member, the, or each, shield member being configured so that, when positioned on the vibrating screen, a vibrational pattern of the screen is imparted to the, or each, shield member; and an adjustment mechanism that is operatively engaged with the, or each, shield member to adjust a position of a discharge end of the, or each, shield member relative to the discharge end of the screen.

The shield member may be configured so that the vibrational pattern imparted to the, or each, shield member is imparted to a layer of the particulate material on the, or each, shield member to encourage stratification of the particulate material prior to the particulate material being fed onto the screen from the discharge end of the, or each, shield member The, or each, shield member may be in the form of a mat.

The mat may be fed from a roller assembly.

The mat may be articulated and may include lengths of mat sections that are pivotal with respect to each other.

The mat may be of an elastomeric material.

The accessory may include a support structure and a roller assembly mounted on the support structure and engaged with opposite sides of the mat so that operation of the roller assembly results in displacement of the mat, the roller assembly being configured so that the mat can be extended or retracted by the roller assembly.

The support structure may be configured for displacement towards and away from a deck of a screening apparatus.

Casters or wheels may be mounted on the support structure and configured for engagement with a pair of rails so that the support structure can be reciprocally displaced along the rails.

The roller assembly may include a drum roller onto which the mat is wound and a drive roller that is linearly displaceable towards and away from the drum roller so that the drive roller can bear against the mat and can be adjusted to accommodate effective increases and decreases in diameter of the drum roller as the mat is wound onto and off the drum roller, respectively.

At least the drive roller may be a driven roller and may incorporate a drive mechanism that is configured for control by a data processing apparatus such that an extent of retraction or extension of the mat can be controlled by the data processing apparatus.

The roller assembly may include a drum roller, a drive roller that is linearly displaceable towards and away from the drum roller and an idler roller that is also linearly displaceable towards and away from the drum roller, the drum roller being positioned beneath the mat and the drive and idler rollers being positioned above the mat and spaced from each other such that a length of the mat extends from a position between the drive roller and the drum roller and another position between the idler roller and the drum roller.

At least the drive roller may be a driven roller and may incorporate a drive mechanism that is configured for control by a data processing apparatus such that an extent of retraction or extension of the mat can be controlled by the data processing apparatus.

The roller assembly may include a drum roller onto which the mat is wound, a linearly reciprocal clamping mechanism being engageable with the mat on a discharge side of the drum roller, the clamping mechanism being linearly reciprocal towards and away from the drum roller to extend and retract the mat.

The clamping mechanism may be mounted on a piston of a hydraulic piston and cylinder arrangement that is operable to displace the clamping mechanism reciprocally, the clamping mechanism being operable to open before the piston is retracted and to clamp onto the mat before the piston is extended, both the hydraulic piston and cylinder arrangement and the clamping mechanism being configured for control by a data processing apparatus such that an extent of retraction or extension of the mat can be controlled by the data processing apparatus.

The drum roller may incorporate a braking mechanism that is operable when the clamping mechanism is opened to retain the mat in position during retraction of the piston.

The accessory may include a control arrangement that controls the adjustment mechanism.

The control arrangement may be configured to permit direct control of an extent of adjustment of the relative positions of the discharge ends of the, or each, shield member and screen, respectively.

The control arrangement may include an infeed sensing arrangement for sensing an infeed rate of particulate material onto the shield member and an outfeed sensing arrangement for sensing at least one of an outfeed rate of screenings and an outfeed rate of discharge from the screen.

The control arrangement may include a data processing apparatus that is configured to receive signals from the sensing arrangements and to generate suitable output signals for the adjustment mechanism so that the adjustment mechanism can be controlled automatically to adjust a particle size distribution of at least one of the discharge and the screenings.

The sensing arrangements may include weigh-in-motion devices, one of which can be positioned upstream of the screen and at least one other can be positioned to receive either the discharge or the screenings.

The sensing arrangements may include at least one sensor that can be operatively arranged with respect to the screen to sense at least one of particle size distribution within particulate material fed to the shield member, particle size distribution within screenings and particle size distribution within discharge.

In another aspect, there is provided a method of screening a particulate material, the method comprising the steps of feeding the particulate material on to at least one shield member that is positioned on a screen, having a feed end and a discharge end, of a vibrating screen assembly and that is configured to cover part of the screen between the feed end and a position intermediate the feed and discharge ends, the, or each shield member being configured so that, when positioned on the vibrating screen, a vibrational pattern of the screen is imparted to the, or each, shield member; and adjusting a position of a discharge end of the, or each, shield member relative to the discharge end of the screen according to a desired particle size distribution of at least one of screenings and discharge.

The step of adjusting the position of the discharge end of the, or each, shield member relative to the discharge end of the screen is carried out to adjust at least a length of time spent by the particulate material on the, or each, shield member to achieve granular convection within the particulate material at the discharge end of the shield member.

The method may include the steps of:

sensing an infeed rate of the particulate material onto the, or each, shield member and an outfeed rate of at least one of screenings and discharge from the screen;

generating outputs carrying information relating to the infeed and outfeed rates; and adjusting a position of the discharge end of shield member in response to inputs carrying the information and received by a data processing apparatus.

The step of adjusting the position of the, or each, shield member is carried out by the data processing apparatus.

In another aspect, there is provided a method of screening a particulate material, the method comprising the steps of:

feeding the particulate material on to at least one shield member that is positioned on a screen, having a feed end and a discharge end, of a vibrating screen assembly and that is configured to cover part of the screen between the feed end and a position intermediate the feed and discharge ends; and adjusting a position of the, or each, shield member relative to the discharge end of the screen according to a desired particle size distribution of at least one of screenings and discharge.

In another aspect, there is provided a system for processing particulate material, the system comprising:

a first processing unit for processing particulate material; and a screening apparatus positioned downstream of the first processing unit and configured to receive particulate material from the first processing unit, the screening apparatus including a vibrating screen assembly that includes a screen and a vibrating mechanism operable on the screen to cause vibration of the screen, the screen having a feed end and a discharge end;

at least one shield member positioned on the screen and configured to cover part of the screen between the feed end of the screen and a position intermediate the feed and discharge ends of the screen, such that particulate material for screening by the screen can be fed on to the, or each, shield member; and an adjustment mechanism operatively engaged with respect to the, or each, shield member to adjust a position of the, or each, shield member relative to the discharge end of the screen A second processing unit may be positioned downstream of the screening apparatus to receive discharge from the screen assembly for further processing.

DETAILED DESCRIPTION

Figure 1:
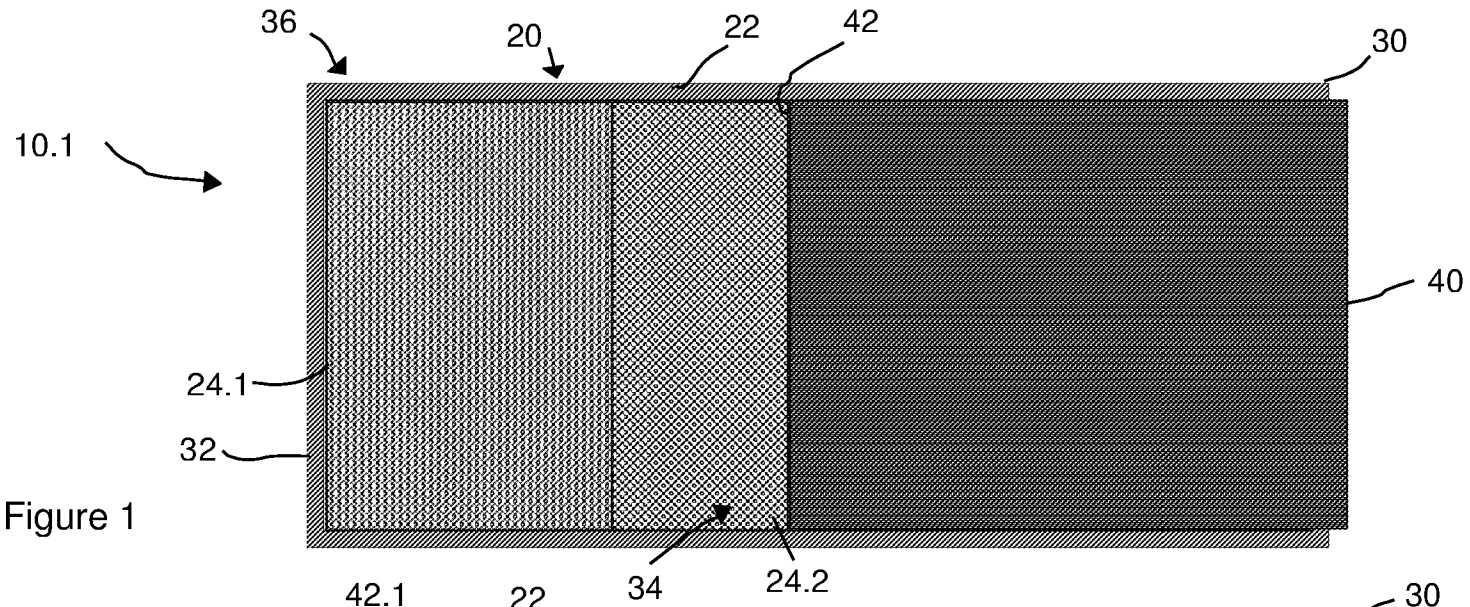
FIG. 1 shows a top plan view of an embodiment of part of a screening apparatus.
Figure 2:
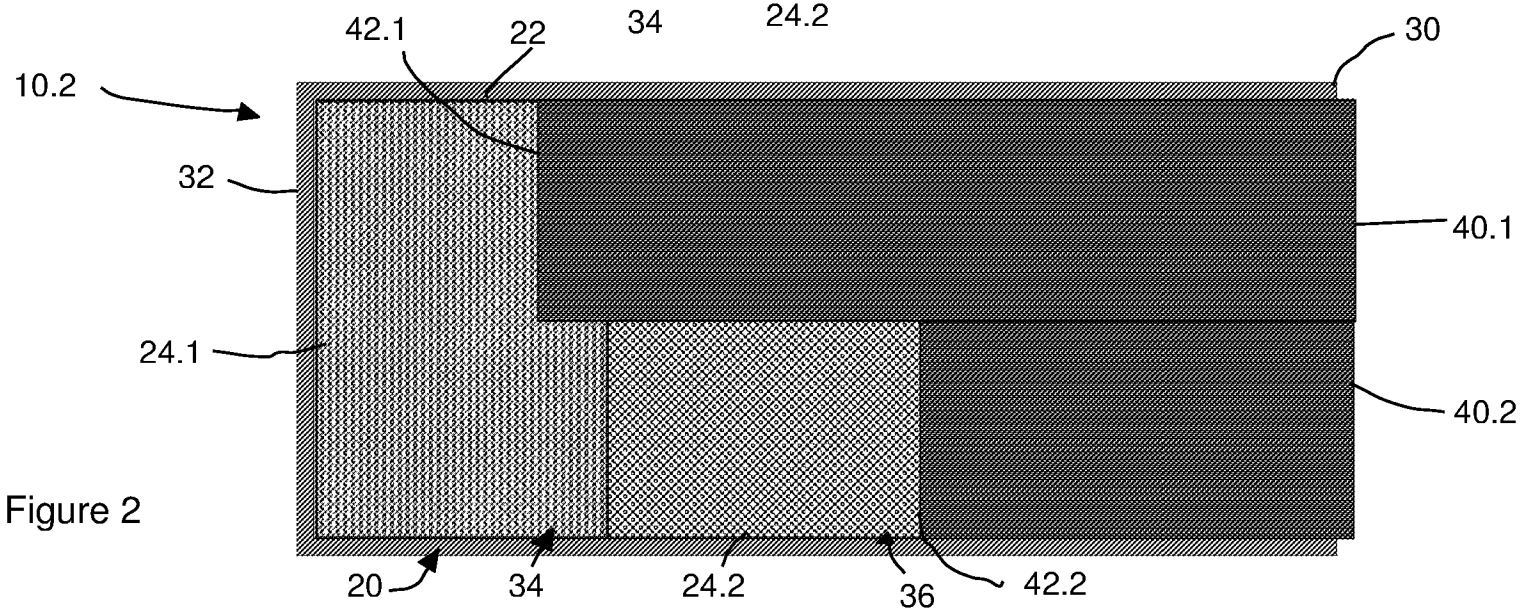
FIG. 2 shows a top plan view of another embodiment of part of a screening apparatus.

FIGS. 1 and 2 show two examples, generally indicated with reference numerals 10.1 and 10.2, respectively, of part of a screening apparatus.

Figure 5:
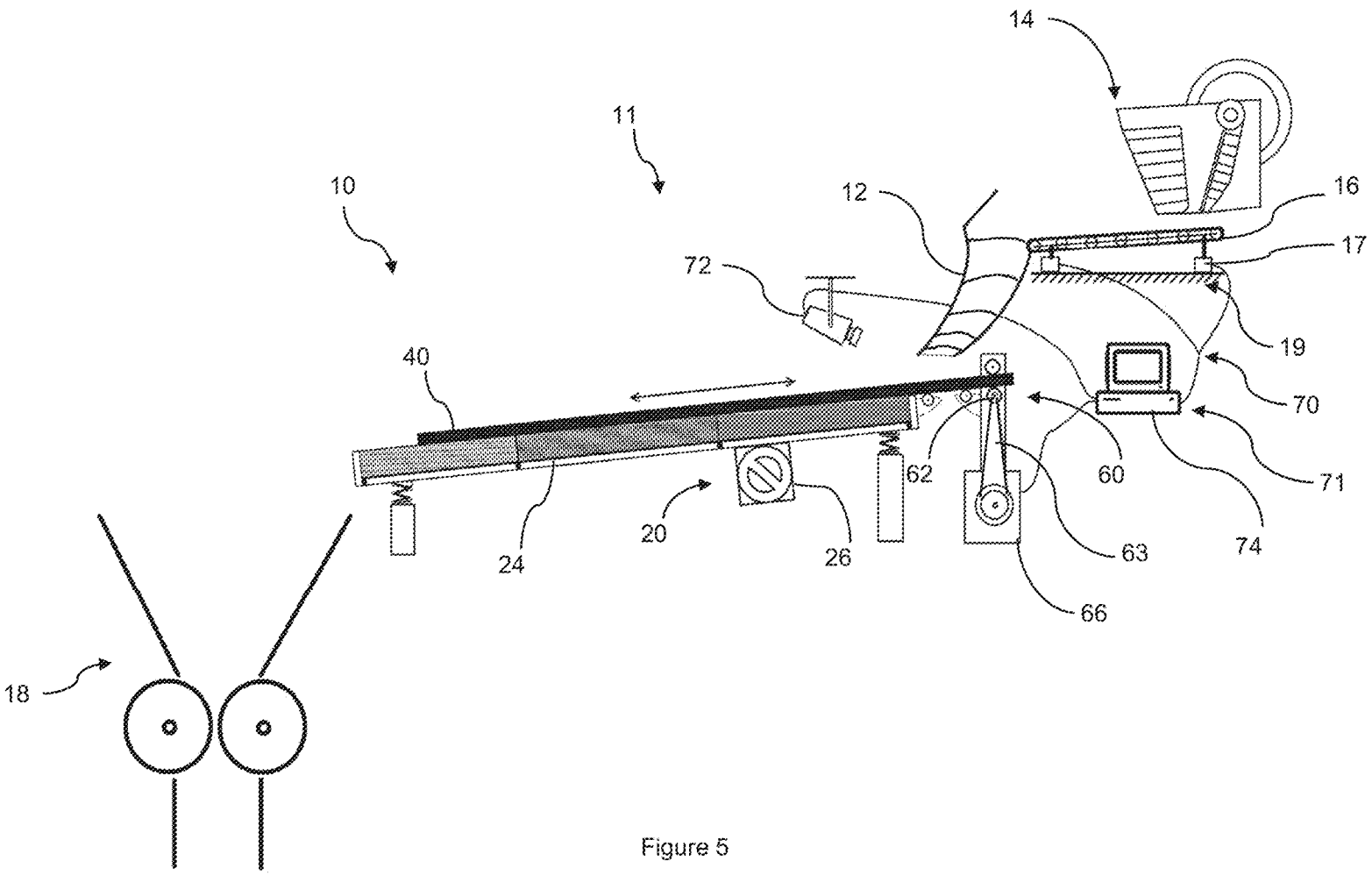
FIG. 5 shows a system for pre-processing particulate material for a crusher using the screening apparatus of either FIG. 1 or FIG. 2.
Figure 6:
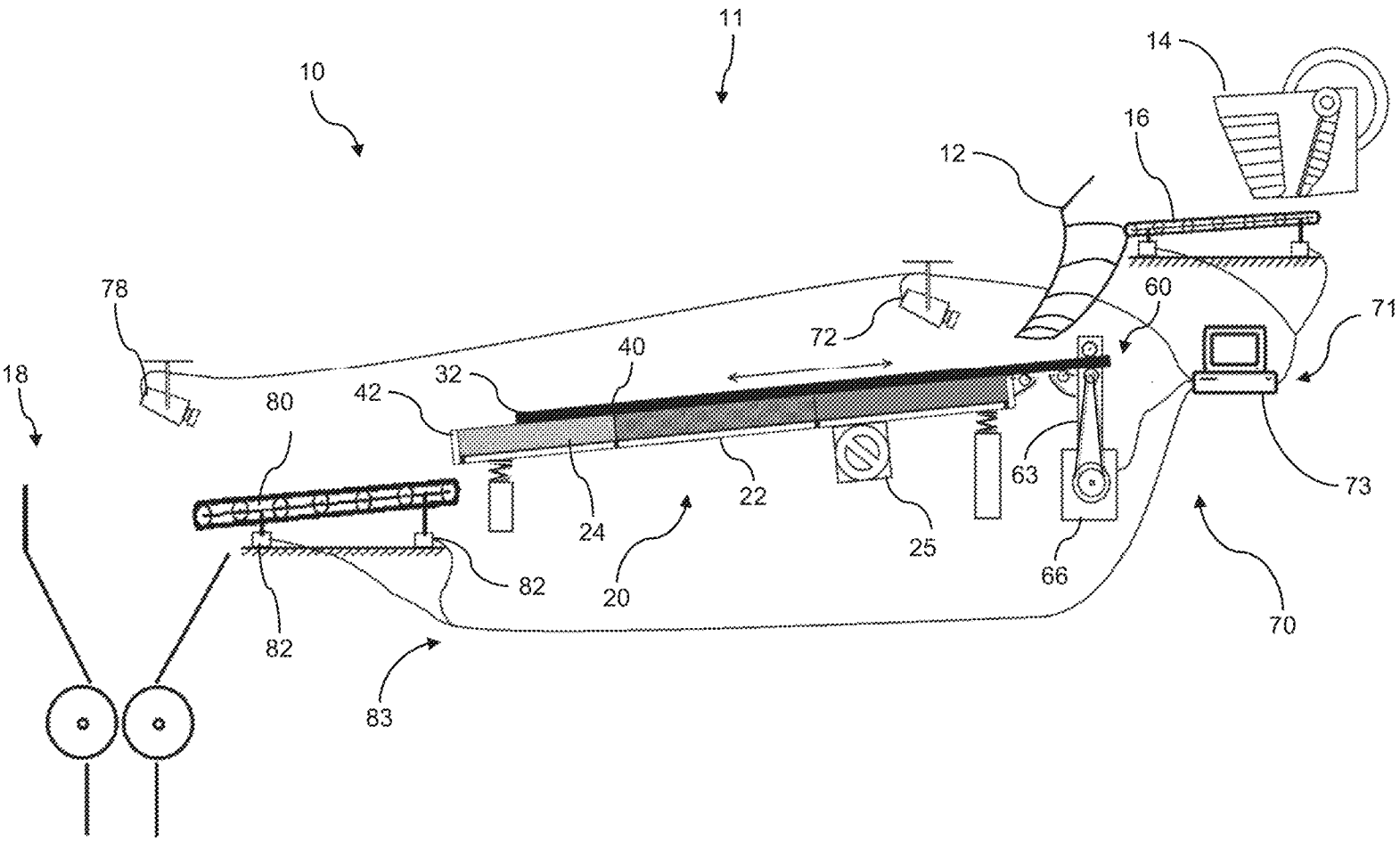
FIG. 6 shows another system for pre-processing particulate material for a crusher using the screening apparatus of either FIG. 1 or FIG. 2.

In a number of embodiments, the screening apparatus 10 is used to process particulate material received from a processing unit in the form of a primary crusher 14, such that the screening apparatus 10 and the primary crusher 14 are in the form of a system 11 for processing particulate material, as shown in FIGS. 5 and 6.

The primary crusher 14 feeds the particulate material onto a feed conveyor 16. The feed conveyor 16 is supported on load cells 17 to define a weigh-in-motion device in the form of a belt weigher or weightometer 19 (FIGS. 5 and 6). Thus, the load cells 17 are configured to generate a signal representing a feed rate to a controller or computer, as is described in further detail below. It is to be appreciated that the weigh-in-motion device can take other forms, as may be known in the field. In a typical application, such as in a quarry, the feed rate could be between about 300 tonnes per hour to 250 tonnes per hour. It will this be appreciated that the weightometer 19 defines an infeed sensing arrangement.

The apparatus 10 includes a vibrating screen assembly 20, a shield member or shield 40, such as a mat or belt, an adjustment mechanism 60 and a control arrangement 70 (FIGS. 5 and 6). The shield 40 is positioned on the screen assembly 20 so that energy generated by the screen assembly 20 is transferred into reciprocal vibratory motion of the shield 40. This can then be imparted to particulate material positioned on the shield 40 so that the material is displaced towards a discharge end of the screen assembly 20.

In other embodiments, the particulate material is fed directly onto the shield 40 rather than from a crusher.

It is to be appreciated that an accessory for the screening apparatus is also described herein. It is envisaged that the accessory would include the shield 40, the adjustment mechanism 60 and the control arrangement 70 that could be retrofitted to an existing vibrating screen assembly, which could be indicated with reference numeral 20. Examples of the accessory are described below and with reference to FIGS. 12 to 26.

The examples 10.1 and 10.2 are provided as a way of indicating that some form of generic means for displacing the shield 40 relative to the screen assembly 20 can be provided instead of the various embodiments described below. Thus, it is envisaged that various alternatives to the embodiments described below may be applicable. These could include manually retracting or extending the shield with some form of winch arrangement and various other mechanisms that require direct operation by a user or operator.

For example, when the shield 40 is positioned on the screen assembly 20, the vibration of the screen assembly 20 will tend to draw the shield 40 towards a discharge end of the screen assembly 20. This can be a function of existing vibrating screen assemblies that have rotary vibrators that impart a circular or ellipsoidal vibratory motion or vibrational pattern to generally horizontal screen decks so that the particulate matter or aggregate on the screen decks is displaced from the feed end to the discharge end as it vibrates or bounces on the screen decks. It will be appreciated that, with the shield 40 positioned on a screen deck to which such vibratory motion is imparted, the aggregate or particulate material on the shield 40 will also tend to move towards a discharge end of the shield 40 if the shield 40 is restrained against such movement.

The shield 40 can be drawn back towards a feed end of the screen assembly 20 with a suitable pulley or winch arrangement that engages the shield 40 and is operable to draw the shield 40 back against the natural movement of the shield 40 towards the discharge end. It will be appreciated that any other suitable arrangement can be used to draw the shield 40 back. While the deck is vibrating, retraction of the shield 40 is possible with such an arrangement. However, should the deck stop vibrating, the load on the deck and the shield 40 could be too high for the shield 40 to be retracted with that arrangement. In such a case, a mechanical engagement mechanism, such as a clamping arrangement, can be temporarily attached to the shield 40 and connected to a winch to retract the shield 40 from the deck.

The screen assembly 20 includes a deck 22, a screen 24 and a vibrating mechanism in the form of a vibrator 26. The screen assembly 20 is also sometimes known as a shaker. As is known, such vibrators include an offset weight that is rotated to generate a vibrational pattern in the screen assembly. The configuration of the weight and the manner in which it is offset provides a desired vibrational pattern.

The deck 22 is supported above a substrate by legs 28. The deck 22 is usually inclined. However, as intimated above, the deck 22 can also be generally horizontal with the vibrational pattern imparting movement of the particulate material towards the discharge end. The legs 28 allow movement of the deck 22 when the vibrator 26 is energized.

The deck 22 supports or includes the screen 24. The screen 24 has a feed end 30 and a discharge end 32. A screen area 34 is defined as the area between the feed end 30 and the discharge end 32. Aggregate or particulate material passing through the screen area 34 is referred to as "screenings". Particulate material that does not pass through the screen area 34 and passes over the discharge end 32 is referred to as "discharge". It is to be noted that the particulate material can take many forms. These could include shells of nuts, wood chips, and various other forms of particulate material. The particulate material could also include a broad range of overall sizes, from relatively fine granular material, such as powders, to larger aggregate material such as aggregate mined at a quarry.

Holes or apertures in the screen 24 may be of a uniform size throughout the screen 24. In another embodiment, as shown in FIG. 1, the screen 24 may be divided into zones 24.1 and 24.2. The zone 24.1 has holes or apertures which are uniform in size. The zone 24.2 has holes or apertures which are uniform in size. The holes in the zone 24.1 are of a different size to the holes in the zone 24.2. In the embodiment shown in FIG. 1, the holes in the zone 24.1 are smaller than the holes in the zone 24.2. In another embodiment, the holes in the zone 24.1 are larger than the holes in the zone 24.2. In various embodiments, holes or apertures in a region at or near the discharge end 32 are smaller than holes or apertures in a region further from the discharge end 32. It will thus be appreciated that the particulate material can be fed to a particular zone depending on the position of the shield 40.

Only two zones 24.1 and 24.2 are shown, but it will be appreciated that the screen 24 may have any number of zones with different sized holes. The screen 24 may be made up of a number x of removable sections, with each section defining a zone 24.*x*.

The shield 40 may be in the form of a mat or belt. At least part of the shield 40 is positioned on the screen 24 to cover part of the screen area 34.

An area 36 within the screen area 34, which is not covered by the shield 40, is hereinafter referred to as the "effective screen area". The effective screen area 36 is varied by adjusting the position of the shield 40 relative to the discharge end 32.

The shield 40 has a discharge end 42. The discharge end 42 is transverse to the longitudinal extension of the screen 24 between the feed end 30 and the discharge end 32 of the screen 24.

Adjusting the position of the shield 40 includes moving the discharge end 42 along a line between the feed end 30 and the discharge end 32. The effective screen area 36 is defined between the discharge end 42 of the shield 40 and the discharge end 32 of the screen 24. The closer the distal end 42 of the shield 40 is to the discharge end 32 of the screen 24, the smaller the effective screen area 36. The closer the discharge end 42 of the shield 40 is to the feed end 30 of the screen 24, the larger the effective screen area 36.

In the example indicated by reference numeral 10.2 in FIG. 2, instead of a single mat 40, two side-by-side mats 40.1, 40.2 are provided. These can be used to vary the exposure of the aggregate or particulate material to the zones 24.1, 24.2 to achieve a greater variation in product than would be the case with one mat 40. The inventor(s) envisages that three or more such side-by-side mats could also be provided further to vary the product.

Figure 7:
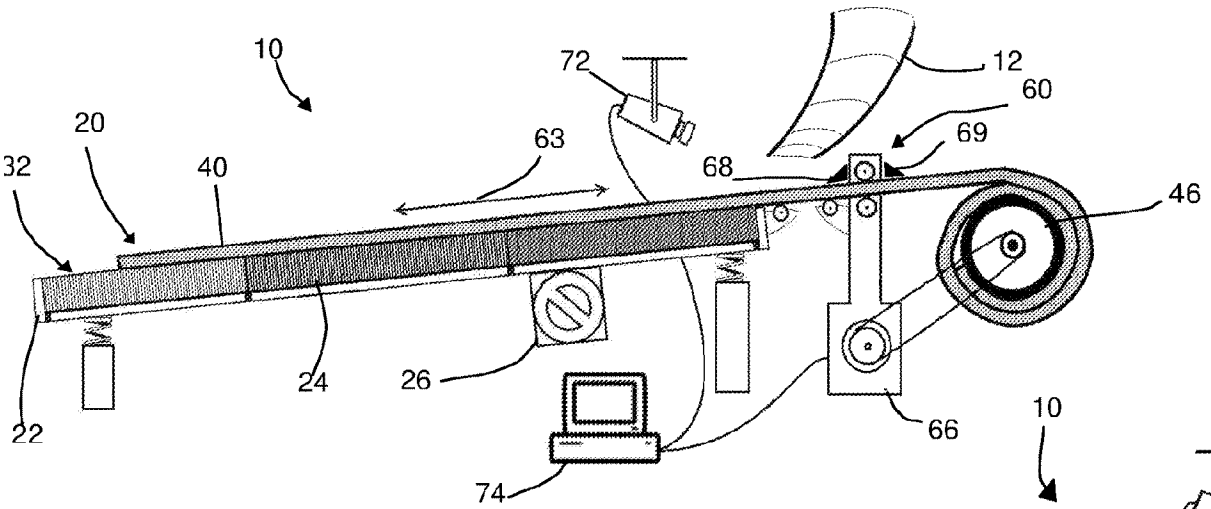
FIG. 7 shows a side view of the screening apparatus of either FIG. 1 or FIG. 2, including a diagrammatic depiction of one example of a shield member.

In one example, the shield 40 is a length of flexible or resilient sheet material that is fed from a roller 46 as shown in FIG. 7. The shield 40 may be a mat of elastomeric material.

An example of a suitable material for the shield 40 is that used for conveyor belts. In this case, the shield 40 can have a thickness of between about 1 mm and 100 mm, depending on the application. It will be appreciated that such material can help to impart the vibratory motion of the screen 24 to the particulate material. For example, when the shield 40 is thinner, it can be used with particulate material having a smaller aggregate size. Alternatively, when the shield 40 is thicker, it can be used with particulate material having a larger aggregate size. For example, it is envisaged that the shield 40, together with a screen assembly with appropriate characteristics, can be used with material in a powdered form right up to material received from a rock crusher.

Figure 8:
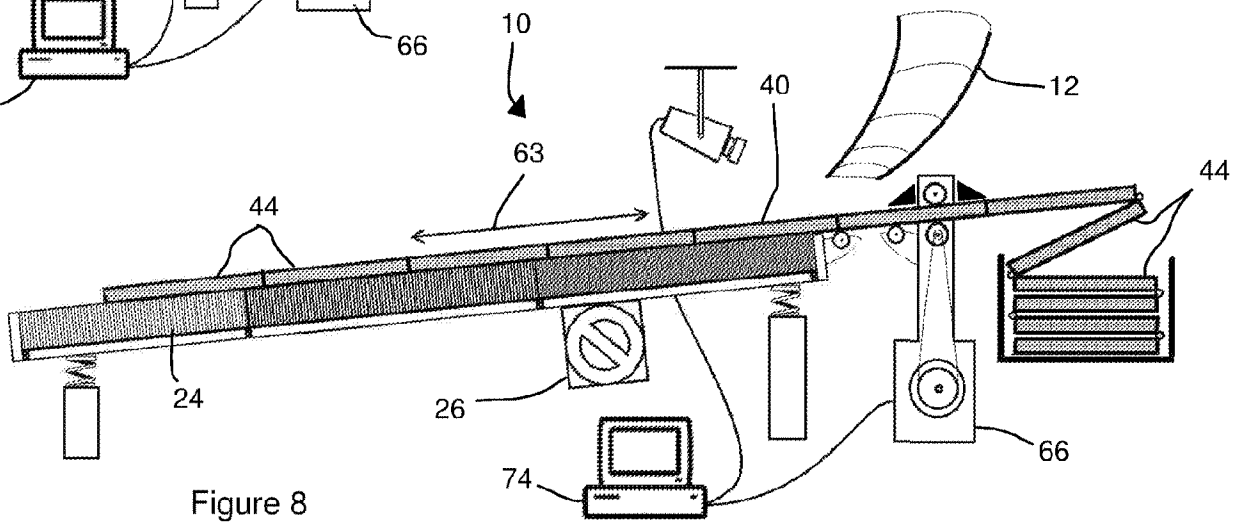
FIG. 8 shows a side view of the screening apparatus of either FIG. 1 or FIG. 2, including a diagrammatic depiction of another example of a shield member.

In another embodiment, the shield 40 comprises sections 44 which fold together as shown in FIG. 8. The sections 44 are articulated or hinged together. The sections 44 can have a level of resilience to enhance the vibratory motion imparted to the particulate material on the shield 40. The sections 44 can have the characteristics described above with reference to the thickness.

The shield 40 can dampen sound generated by the screen 24 as the particulate material is processed.

In many screening applications, the screen does not present a planar surface. Rather, the screen can be bowed. Thus, the material of the shield 40 is selected so that the shield 40 can conform to the shape of the screen when positioned on the screen.

In some applications, the screen may have components of fasteners extending upwardly from the screen. In the event that these are of excessive length, they can be shaved off with a suitable tool prior to making use of the apparatus 10.

The inventor(s) envisages that, in most cases, the shield can move to and fro over the fasteners.

The position of the shield 40 along the screen 22 is controlled by the adjustment mechanism 60.

Figure 3:
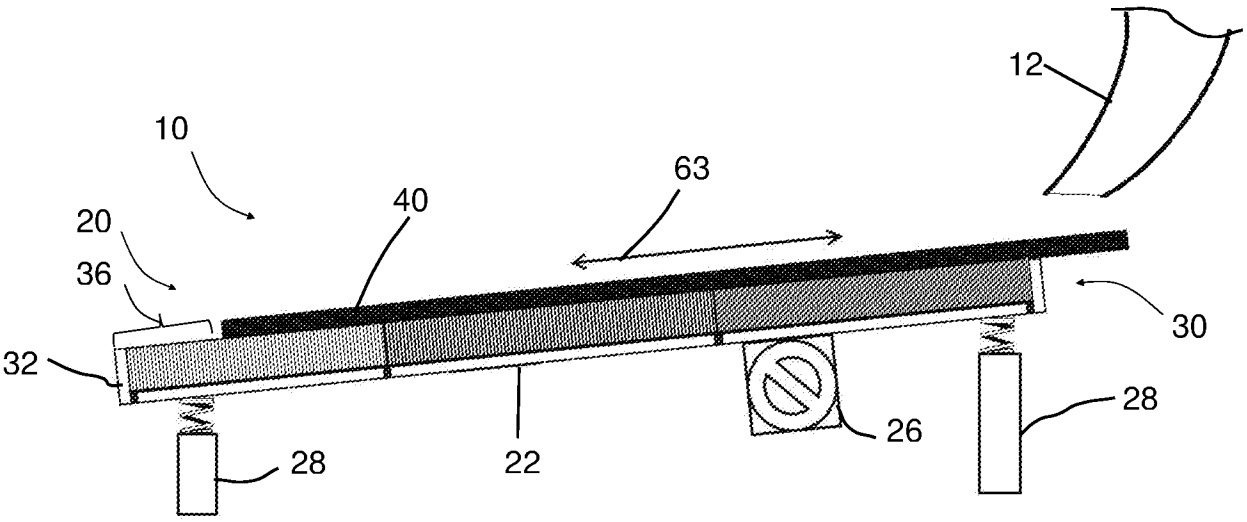
FIG. 3 shows a side view of the screening apparatus of either FIG. 1 or FIG. 2, with a shield member in an extended position.
Figure 4:
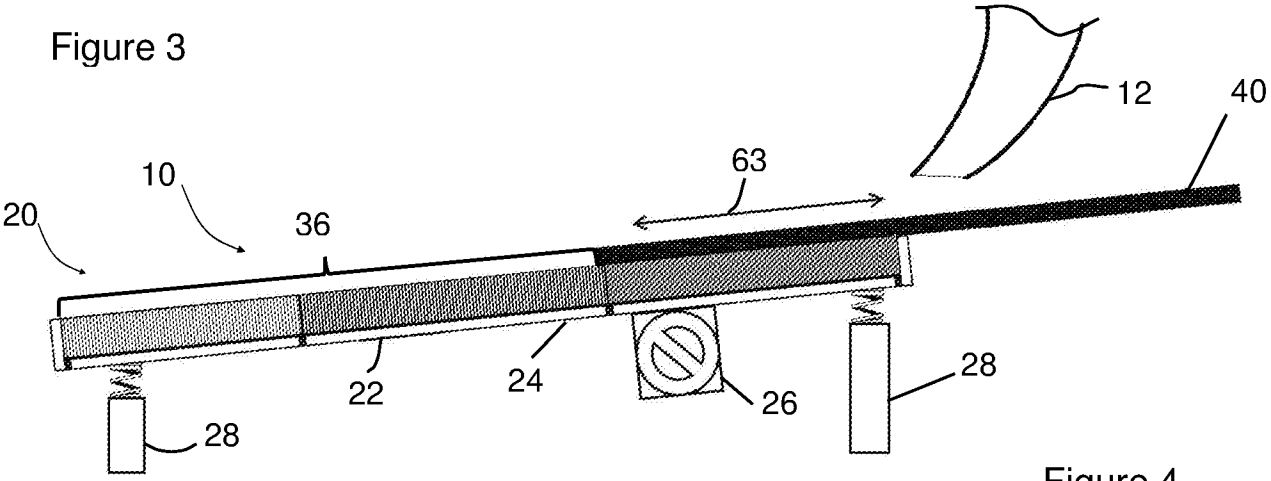
FIG. 4 shows a side view of the screening apparatus of either FIG. 1 or FIG. 2, with a shield member in a retracted position.

The adjustment mechanism 60 includes roller assemblies having one or more drive rollers 62. The drive rollers 62 engage opposite sides of the shield 40. Alternatively, a drive roller can engage one side while an idler roller engages an opposite side. The drive rollers 62 are driven with a suitable drive mechanism, such as a stepper motor 66 and a suitable transmission mechanism to adjust a position of the shield 40 between that shown in FIG. 3 and that shown in FIG. 4, for example, as indicated by an arrow 63. Instead of the stepper motor 66, the drive mechanism can include a hydraulic motor and gearbox assembly. The hydraulic motor and gearbox assembly is a preferred option in those cases in which the apparatus 10 is used with crushed rock and similar aggregate. In the example shown in FIGS. 5 and 6, the drive rollers 62 can be driven by a belt or chain indicated at 63 connected to an output of the drive mechanism 66.

A scraping member or scraper 68 is positioned downstream of the drive rollers 62 to engage the shield 40 (FIGS. 7, 8). In operation, the scraper 68 serves to scrape or remove material from the shield 40 so that the material does not interfere with the operation of the drive rollers 62. A further scraper 69 is positioned upstream of the drive rollers 62 to engage the shield 40. In operation, the scraper 69 also serves to scrape or remove material from the shield 40. It will be appreciated that other arrangements can be used for cleaning the shield 40, during operation, to protect the drive rollers 62.

The control arrangement 70 includes a control mechanism 71 that is operatively connected to the adjustment mechanism 60 to control the position of the shield 40. The control arrangement 70 includes the weightometer 19 that is connected to the control mechanism 71. The control mechanism 71 includes a controller in the form of a data processing apparatus, device or computer 74. The data processing device can also be in the form of, or include, a programmed logic controller (PLC), as described below with reference to FIG. 27.

The control mechanism 71 includes a sensor or infeed sensing arrangement in the form of a camera 72 that is configured to generate a video signal for transmission to the computer 74. The computer 74 can be configured to process the video signal in order to generate data relating to characteristics of the particulate material that is fed onto the shield 40. The computer 74 is configured to control operation of the drive rollers 62, for example, in a manner that relates to the data received from the camera 72.

The control arrangement 70 is configured to control an extent of adjustment of the relative positions of the discharge ends 32, 42 of the, or each, shield and screen, respectively.

The embodiment of the control arrangement 70 shown in FIG. 6 includes a second camera 78 that can define an outfeed sensing arrangement. The second camera 78 is positioned and configured to transmit or stream a video signal representing the discharge received on a discharge conveyor 80. The computer 74 can be configured to process the video signal from the second camera 78 to generate data relating to characteristics of the discharge. The computer 74 is configured to control operation of the drive rollers 62, for example, in a manner that relates to the data received from the cameras 72, 78.

The control arrangement 70 also includes a pair of load cells 82 on which the conveyor 80 is mounted. Thus, the conveyor 80 can include a weightometer 83. The weightometer 83 is connected to the computer 74 to provide a signal to the computer 74 representing a feed rate across the conveyor 80. It will be appreciated that a difference between values generated by the weightometer 19 and the weightometer 83 can be used to provide an indication of the rate at which material passes through the effective area 36. Thus, the weightometer 83 defines an outfeed sensing arrangement.

The discharge conveyor 80 can be positioned upstream of a further processing unit, for example a secondary crusher 18, so that the discharge can be fed to the secondary crusher 18 for further processing, for example, crushing.

In other embodiments, the control arrangement 70 can include a third camera that is positioned and configured to transmit or stream a video signal representing the screenings passing through the effective area 36.

It is envisaged that the cameras or other devices such as x-ray devices could replace the weightometers 19, 83. Thus, the other cameras or devices referenced by 72, 78, could form part of an imaging system of a particle distribution analyser(s) capable of generating a signal that represents a value relating to a particle size distribution of the particulate material.

It may be counter-intuitive to block part of a screen, because it is generally considered desirable that as much screen area be used as possible. However, the shield 40 can serve useful purposes, as is set out below.

It will be appreciated that the longer a layer of particulate material is exposed to a vibrating screen, the more screen-sized particulate material will pass through the screen as the screenings and less will pass over the screen as the discharge. It follows that, for a given rate of feed over a known area of screen, a size distribution can be estimated. Thus, it is possible to alter the size distribution of the discharge and screenings by altering the effective area 36 by adjusting the position of the shield 40.

Thus, it is possible to achieve a smaller size distribution by reducing the effective area 36 or a larger size distribution by increasing the effective area 36.

For the purposes of this description, we can assume the following parameters:

a. A=effective screen area (as shown by the effective area 36)

b. S=screen size c. R=feed rate (generated by the weightometer 19)

d. $D_s$=screenings distribution size (average aggregate size in screenings)

e. $D_d$=discharge distribution size (average aggregate size in discharge)

This means that two functions can be obtained. The first being $D_s=f(A,S,R)$ and the second being $D_d=f(A,S,R)$. For the purposes of clarity, we will take S as a constant. This means that $D_s=f(A,R)$ and $D_d=f(A,R)$. It will, however, be appreciated that further variation can be achieved by using the different zones 24.1 and 24.2. Still further variation can be achieved by using the two shields 40.1 and 40.2 together with the two zones 24.1 and 24.2, as shown in FIG. 2. The inventor(s) envisages that any number of shields and zones can be provided to achieve variations in product, as required.

More particularly, for a given feed rate R, an increase in A results in an increase in $D_s$, or a lower proportion of fines in the screenings and an increase in $D_d$, or a higher proportion of oversized particulate material in the discharge. A decrease in A results in a decrease in $D_s$, or a higher proportion of fines in the screenings and a decrease in $D_d$, or a lower proportion of oversized particulate material in the discharge.

To obtain a level of usefulness out of this characteristic, a number of runs of the screening apparatus 10 can be carried out together with static measurements so that a general measurement of both $D_s$ and $D_s$ can be obtained for various positions of the shield 40, which are directly proportional to A, and various values of R. These values can be used to program the computer 74 to control operation of the adjustment mechanism 60. For example, these values can be used to generate a function with which the computer 74 can be programmed. In other words, a library of product characteristics and their associations with the parameters described above can be generated for future use, either automatically, by the computer 74 or by an operator simply adjusting the shield with reference to a printout or a screen reading.

After set up, the computer 74 can be configured to receive a signal generated by the weightometer 19 and can be programmed with the function which contains the parameters A and R, as mentioned above. Thus, the computer 74 can be used to execute both the functions mentioned above to control, at least to some extent, $D_s$ and $D_d$.

The camera 72 can be used instead of the weightometer 19 to provide a signal to the computer 74 that carries data relating to the particulate material fed onto to the shield 40. At the same time, the camera 78 can provide a signal to the computer 74 that carries data relating to the discharge. This data, together with the data relating to the particulate material fed onto the shield 40, can be used dynamically to adjust the parameter A. This could be done with a feedback loop containing suitable buffers.

It is to be appreciated that the screening apparatus 10 finds use as a processing unit within a larger crushing and screening arrangement. The screen assembly 20 can be used, as part of the apparatus 10, to achieve required screenings distribution sizes and discharge distribution sizes.

For example, in some cases, it would be desirable to achieve screenings with a relatively higher proportion of fines as opposed to pebbles. In that case, it would not be necessary to replace the screen 24 with a different screen having a different screen size. Such a process can be laborious and time-consuming. Rather, the position of the shield 40 can simply be adjusted to reduce the effective area 36. As set out above, this will result in a smaller value of $D_s$ and a larger value of $D_d$, with the discharge being fed to a further processing unit such as another screen or a secondary crusher.

In other cases, it might be desirable to achieve screenings with the same amount of fines but with a higher amount of pebbles. Again, in that case, it would not be necessary to replace the screen 24 with a different screen having a different screen size. Rather, the position of the shield 40 can simply be adjusted to increase the effective area. As set out above, this will result in a larger value of $D_s$ and a smaller value of $D_d$, also with the discharge being led to a further processing unit such as another screen or a secondary crusher.

As set out above, the shield 40 is positioned on the screen 24. As a result, vibration of the screen 24 is imparted to the shield 40. Thus, the layer of particulate material also vibrates. As a result, fines within the layer of particulate material tend to migrate towards the shield 40 in a process that is called "granular convection". This is a relatively well-known phenomenon and is also referred to as the "Brazil nut effect". In principle, when a mixture containing discrete particles of different sizes is vibrated, the larger particles tend to move upwardly, against gravity. In this specification, the phrase "granular convection" is to be regarded as having the same meaning as "stratification".

It will be appreciated that the longer the particulate material remains on the shield 40, the more the effect of granular convection, up to a certain degree. Thus, the action of reducing the effective area 36 has the effect of increasing granular convection and thus also emphasising or amplifying a reduction in $D_d$.

This can be particularly useful for reducing a level of fines in a particulate material prior to feeding that particulate material to a secondary crusher. Thus, in one application, the effective area 36 can be reduced to such an extent that the use of the screening apparatus 10 is significantly limited to a pre-processing operation for the secondary crusher 18. In that application, the screening apparatus 10 can also achieve a high proportion of fines product for feeding into other products or for use by itself.

Figure 9:
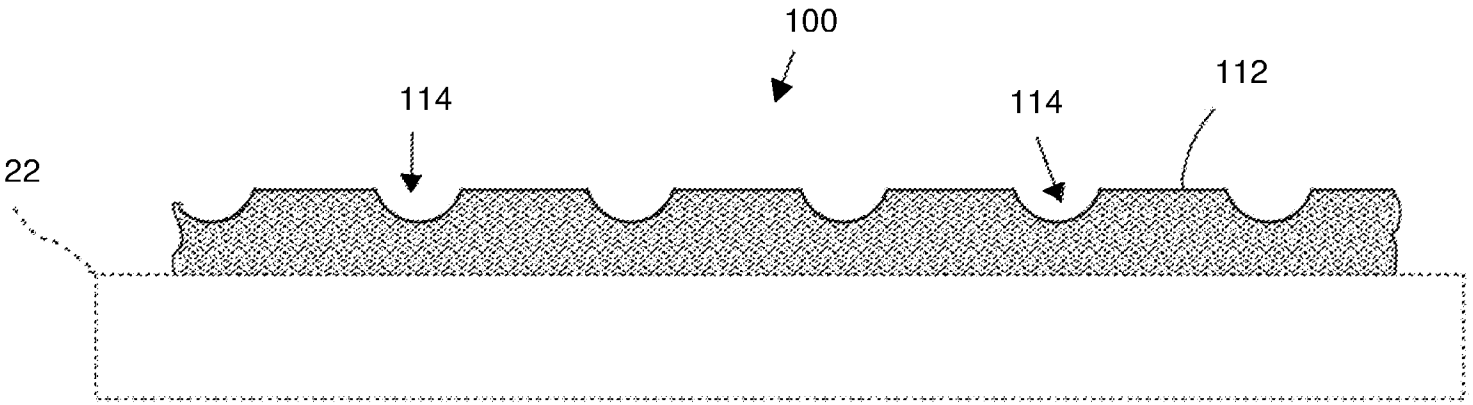
FIG. 9 shows a sectioned view, through A-A in FIG. 10, of an exemplary embodiment of a shield member for the screening apparatus.
Figure 10:
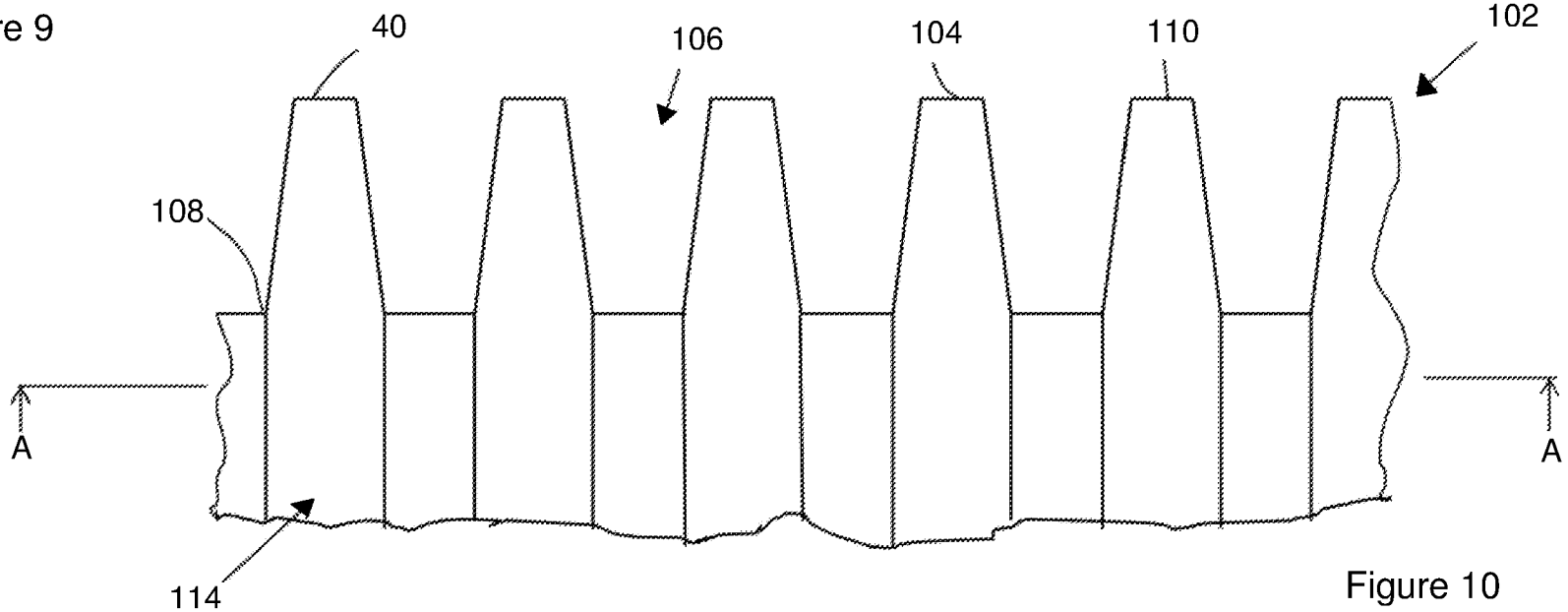
FIG. 10 shows a discharge end portion of an exemplary embodiment of a shield member for the screening apparatus.

In FIGS. 9 and 10, reference numeral 100 generally indicates an exemplary embodiment of a shield member for the apparatus 10.

A discharge end portion 102 defines several fingers 104, extending in a discharge direction. The fingers 104 are spaced to define consecutive discharge zones 106.

Each of the fingers 104 has a base 108 and a free end 110. The base 108 is wider than the free end 110 so that each finger 104 tapers towards the discharge end 42.

An upper surface 112 of the shield 100 defines a series of furrows, grooves or channels 114 that extend longitudinally, terminating between the fingers 104. The channels 114 are dimensioned so that, as a result of granular convection, and gravity, finer material, such as fines and smaller particulate matter can move into the channels 114 out of the remainder of the particulate material positioned on the shield 100.

The fingers 104 can have various lengths depending on the required application. For example, the fingers 104 can have a length of between about 300 mm and 500 mm for processing crushed quarry material.

In other various exemplary embodiments, just the fingers 104, without the channels 114, can be provided. Alternatively, just the channels 114, without the fingers 104, can be provided.

It is to be appreciated that the fingers 104 provide access for the fines and finer material to the screen assembly 20 before the larger particulate material. This is further amplified by using the channels 114.

The inventor(s) envisages that the mat or shield member need not incorporate the features of the shield member 100.

The apparatus 10 can be used in other applications. For example, with multiple shields, the control arrangement 70 can be used to control the shields to deliver articles to discrete apertures. This could be used for delivery of articles of certain sizes to associated apertures or openings. This would be useful for sorting and distribution.

Where reasonable, the shield member 100 can find application in the various apparatus, accessories and systems described in the specification. For example, in the various accessories described below, the mats can be in the form of the shield member 100.

Figure 11:
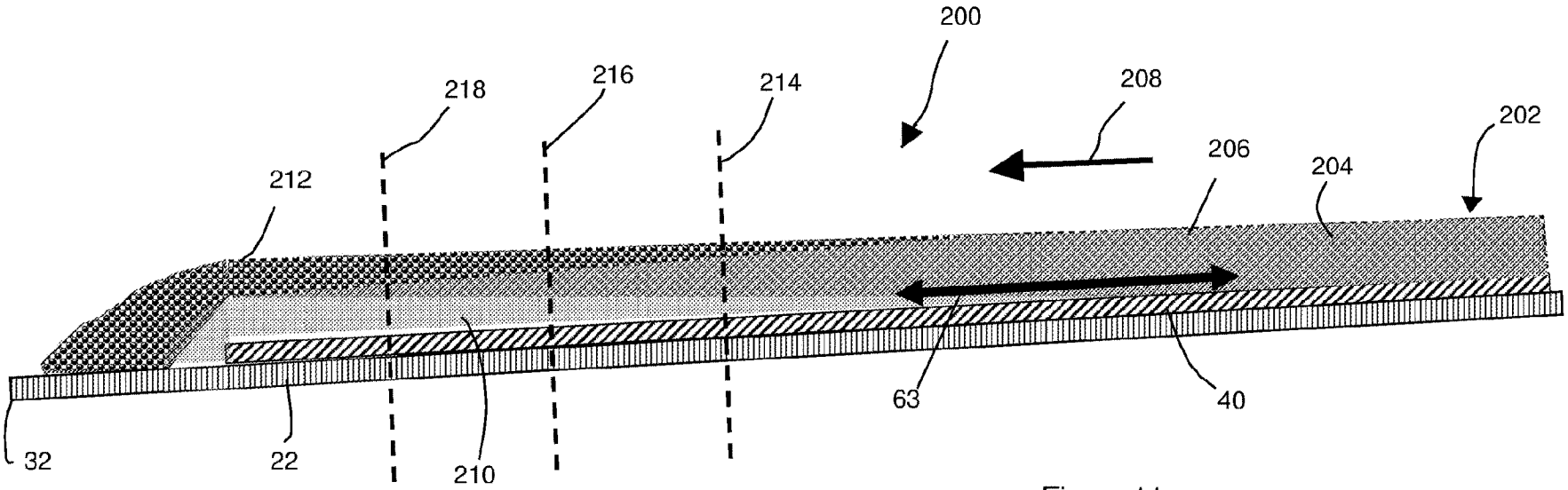
FIG. 11 shows a schematic sectioned side view of a shield member of the screening apparatus carrying particulate matter and illustrating the principle of granular convection occurring within the particulate matter.

In FIG. 11, reference numeral 200 generally indicates the principle of granular convection as applied to the screening or separation of particulate material. The principle illustrated in this drawing is used by the various systems, apparatus and accessories described in the specification to enhance screening or separation of particulate material. As such, the description of the principle is to be understood as being applicable to the various systems, apparatus and accessories described herein.

At a feed end 202 of the shield 40, a layer 204 of the particulate material or aggregate contains a mixture of aggregate material having a range of sizes in a region 206. As the shield 40 vibrates, in the manner described above, fines within the layer 204 begin to move downwardly as the aggregate moves in the direction of an arrow 208 towards the discharge end 32. This results in a fines region 210 developing on the shield 40 and growing thicker towards the discharge end 32. As this occurs, a region 212 of the aggregate containing a reduced level of fines develops and becomes thicker towards the discharge end 32.

At the discharge end 32, fines from the fines region 210 are discharged from the shield 40 onto the deck 22. The discharge of the fines occurs before the discharge of the aggregate from the region 212 because of the position of the fines region 210. Thus, with a suitable selection of the deck 22, the screenings can include a significantly higher proportion of fines than would be the case without the shield 40 and the granular convection occurring as a result of the vibration of the shield 40.

It will readily be appreciated that the longer the particulate material remains on the shield 40, the greater the extent of granular convection and thus the concentration or proportion of fines forming the screenings. For example, the proportion of fines would be less at a position of the discharge end 32 indicated by a dotted line 214 than a position indicated by a dotted line 216 which, in turn, would be less than that indicated by a dotted line 218. Thus, adjustment of a position of the shield 40 relative to the deck 22 can be carried out to adjust a proportion of fines forming the screenings of the deck 22.

Figure 12:
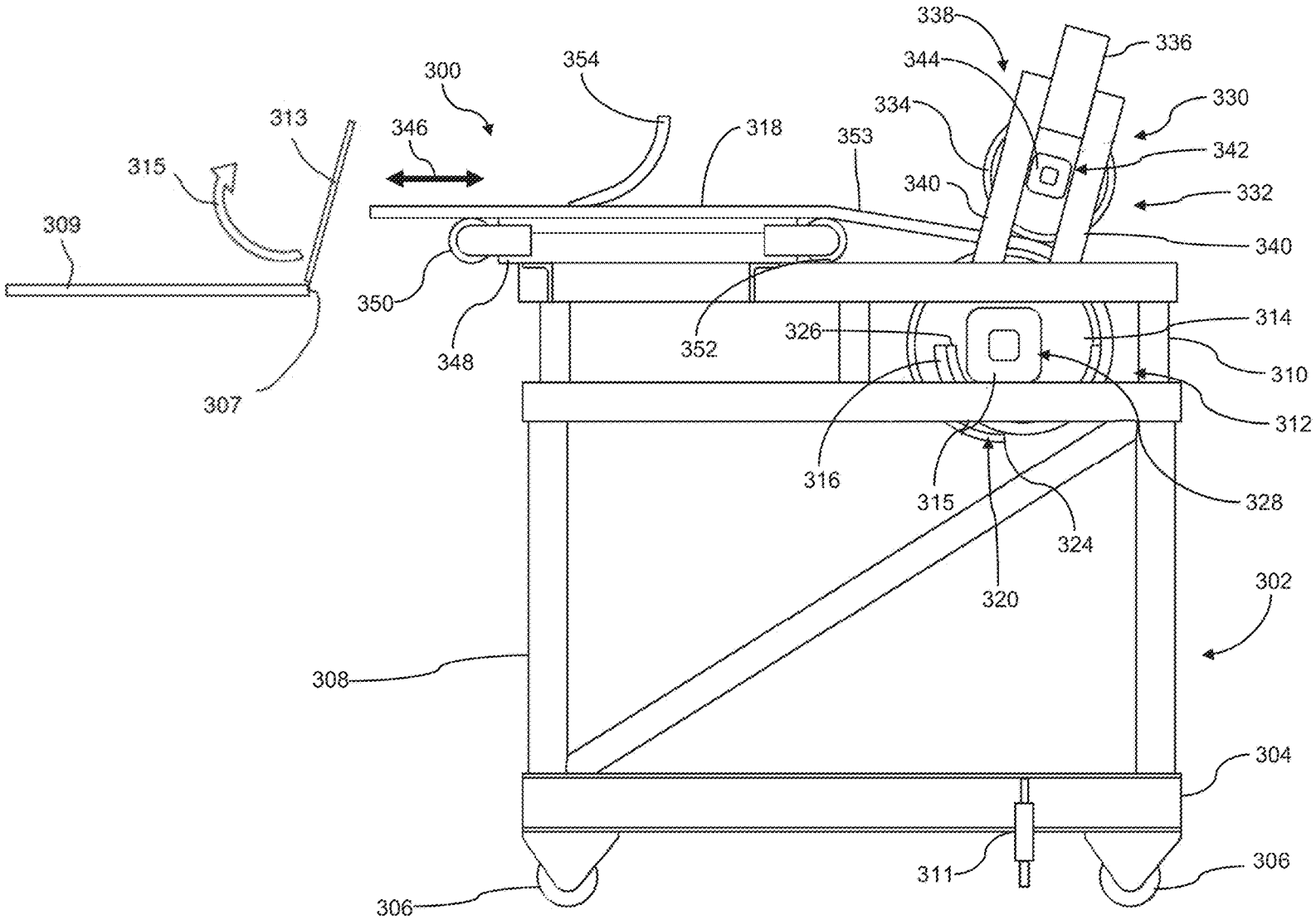
FIG. 12 shows a side view of an example of an accessory for a screening or separating apparatus.
Figure 13:
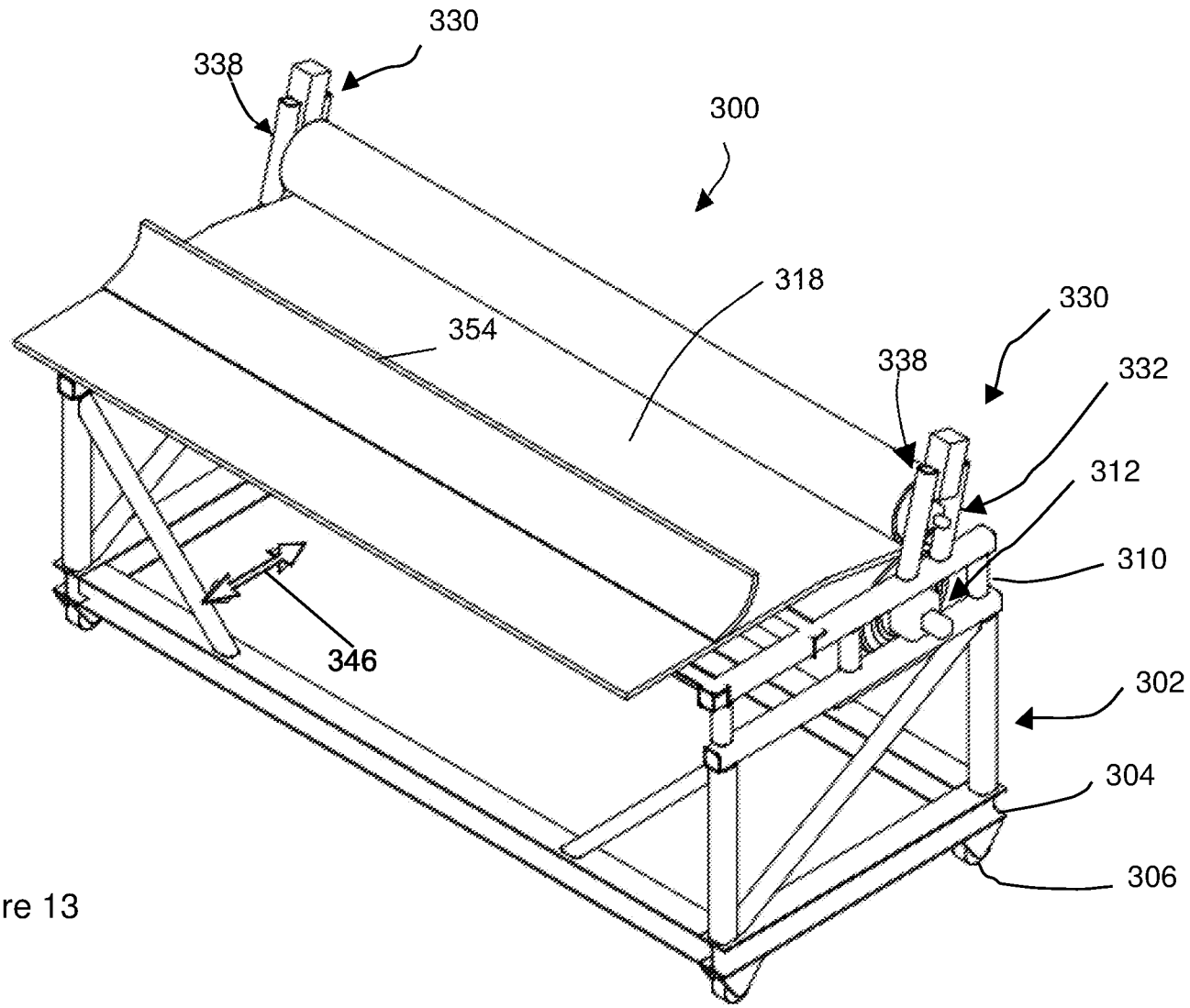
FIG. 13 shows a three-dimensional view, from above, of the accessory of FIG. 12.
Figure 14:
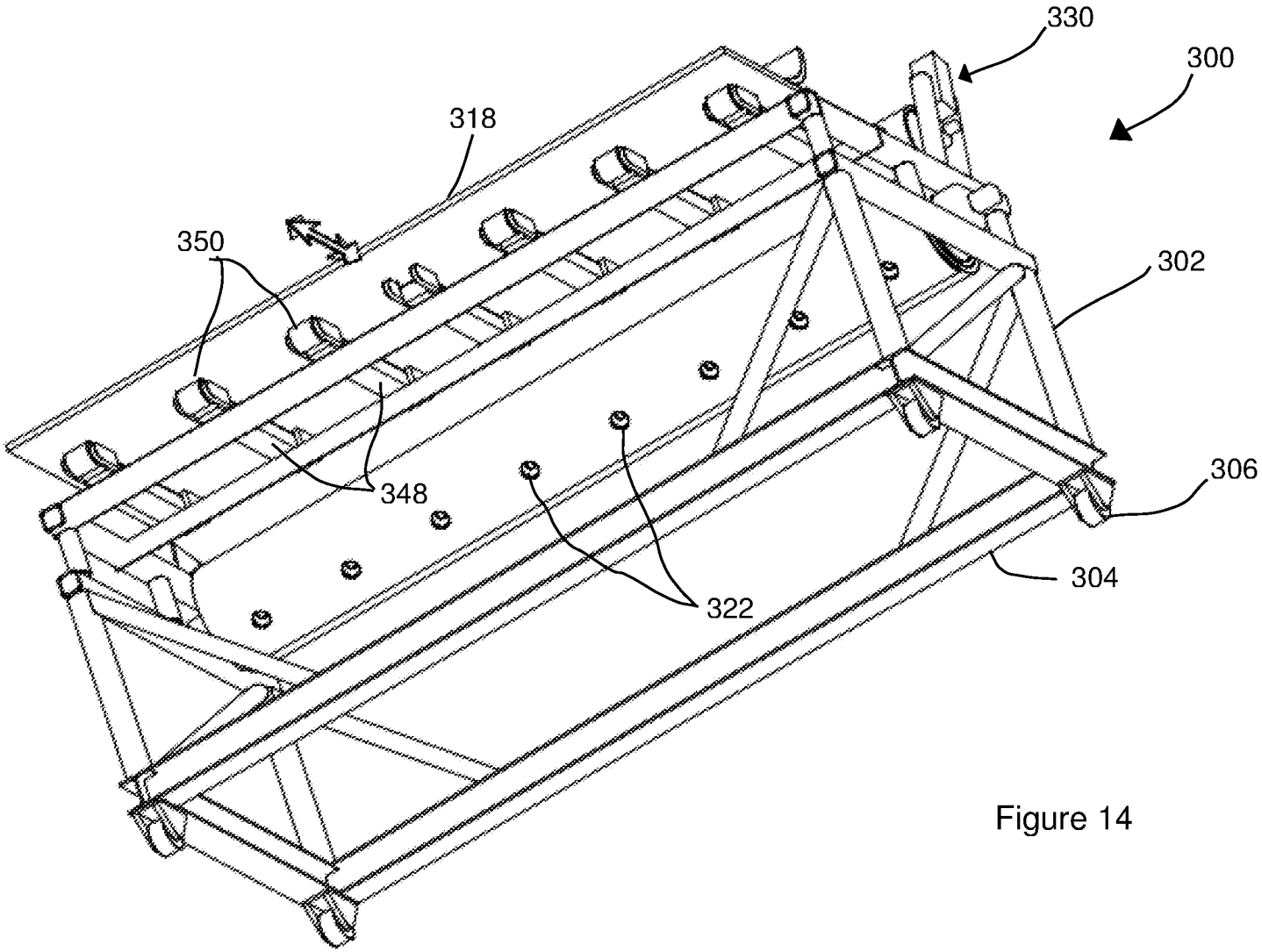
FIG. 14 shows a three-dimensional view, from below, of the accessory of FIG. 12.

In FIGS. 12 to 14, reference numeral 300 generally indicates an example of an accessory for use with a screening or separating apparatus.

The accessory 300 includes a support structure in the form of a support frame 302. The support frame 302 includes a base member 304. Two pairs of wheels or casters 306 are mounted on the base member 304. The casters 306 are configured to engage a pair of rails (not shown) positioned behind a feed end 307 of a screen deck 309 of a screening apparatus or assembly so that the support frame 302 can be wheeled towards and away from the screen deck.

The support frame 302 includes a framework 308 that is mounted on the base member 304. The framework 308 includes a roller support structure 310 positioned above the base member 304.

A drum roller assembly 312 is mounted on the roller support structure 310. The assembly 312 includes a drum roller 314 that is rotatably mounted on a hub 315. One end 316 of a mat 318 is secured to the drum roller 314 so that the mat 318 can be rolled onto the drum roller 314 upon rotation of the drum roller 314. The drum roller 314 defines a slot 320. The end 316 is received in the slot 320 and secured therein by fasteners, such as bolts 322. More particularly, in cross-section, the drum roller 314 has an inward spiral with the slot 320 defined between an external portion 324 and an internal portion 326.

The drum roller assembly 312 incorporates a rotary drum drive mechanism, such as a rotary hydraulic drive, generally indicated at 328. The hydraulic drive 328 can be actuated with a suitable controller, such as a PLC or some other data processing device to rotate the drum roller 314 about the hub 315 to wind the mat 318 onto and off the drum roller 314. As is known, rotary hydraulic drives are reversible. It follows that the hydraulic drive 328 can rotate the drum roller 314 clockwise or anticlockwise depending on whether the mat 318 is to be extended or retracted. Furthermore, the rotary hydraulic drive 328 can be controlled by suitable actuation, for example, by a PLC.

A guide arrangement 330 is mounted on the roller support structure 310 and is configured to permit a drive roller assembly 332 to be mounted above the drum roller assembly 312 and to be displaceable towards and away from the drum roller 314.

The drive roller assembly 332 includes a drive roller 334 that can bear against the mat 318 so that the mat 318 is pinched between the drum roller 314 and the drive roller 334. A linear displacement drive mechanism 336 is engaged with a hub 342 of the drive roller 334 and is operable to drive the drive roller 334 towards and away from the drum roller 314.

The guide arrangement 330 is configured so that axes of rotation of the drum roller 314 and the drive roller 334 are positioned in a plane that is angled rearwardly.

The guide arrangement 330 includes two guide assemblies 338 mounted on respective sides of the roller support structure 310 so that the drive roller 334 is positioned between the guide assemblies 338. Each guide assembly 338 includes a pair of guide rails 340 so that a hub 342 of the drive roller assembly 332 can be received between the guide rails 340 of each pair. The guide rails 340 extend rearwardly from the roller support structure 310.

The drive roller assembly 332 includes a rotary hydraulic drive, generally indicated at 344. The hydraulic drive 344 can also be actuated with a suitable controller such as a PLC or some other data processing device, as described in further detail below.

Thus, actuating the hydraulic drives 328, 344 can result in movement of the mat 318 backwards and forwards, as indicated by an arrow 346 to define the adjustment mechanism described above.

A series of guide rails 348 are mounted on the roller support structure 310 to support the mat 318 as it moves to and fro. A distal guide roller 350 is mounted on a distal end of each guide rail 348 and a proximal guide roller 352 is mounted on a proximal end of each guide rail 348. The word "distal" refers to a position that is relatively distant from the drum roller assembly 312 while the word "proximal" refers to a position that is closer to the drum roller assembly 312 when compared to the distal guide roller 350.

Generally, in the specification, the word "distal" relates to a position that is closer to the feed end 307 of the deck 309 than the "proximal" position.

It will be appreciated that an effective diameter of the drum roller assembly 312 increases as the mat 318 is rolled onto the drum roller 314. The displacement drive 336 is configured to accommodate resultant movement of the drive roller 334 relative to the drum roller 314 while still maintaining an appropriate amount of pressure on the mat 318 to facilitate displacement of the mat 318.

The position of the drum roller assembly 312 is selected so that a length 353 of the mat 318 from the proximal guide rollers 352 to a region of contact with the drive roller 334 is inhibited from being angled upwardly. Excessive upward angling of the length 353 could result in the mat 318 losing contact with the proximal guide rollers 352, which would be undesirable.

The distal guide rollers 350 allow that portion of the mat 318 that extends from the guide rollers 350 to be angled downwardly to some degree without the mat 318 being damaged by ends of the guide rails 348.

A mat scraper 354 is positioned to engage an upper surface 356 to scrape material off the mat 318, so protecting the rollers 314, 334. The scraper 354 can have various profiles. In FIG. 14, the scraper 354 is shown with an arcuate profile. Furthermore, the scraper 354 can be angled in a horizontal plane with respect to a direction of movement of the mat 318 so that material striking the scraper 354 can be diverted off the mat 318. The scraper 354 could, for example, define a forward-facing apex so that the material is diverted off both sides of the mat 318.

It will be appreciated that, in use, a significant amount of tension can be set up in the belt or mat 318. Thus, a fastening arrangement, such as a turnbuckle 311, is mounted on each side of the base member 304 to connect the base member 304 to the rails. The turnbuckle 311 inhibits the accessory 300 from tipping over towards the deck of the apparatus, in use.

Figure 15:
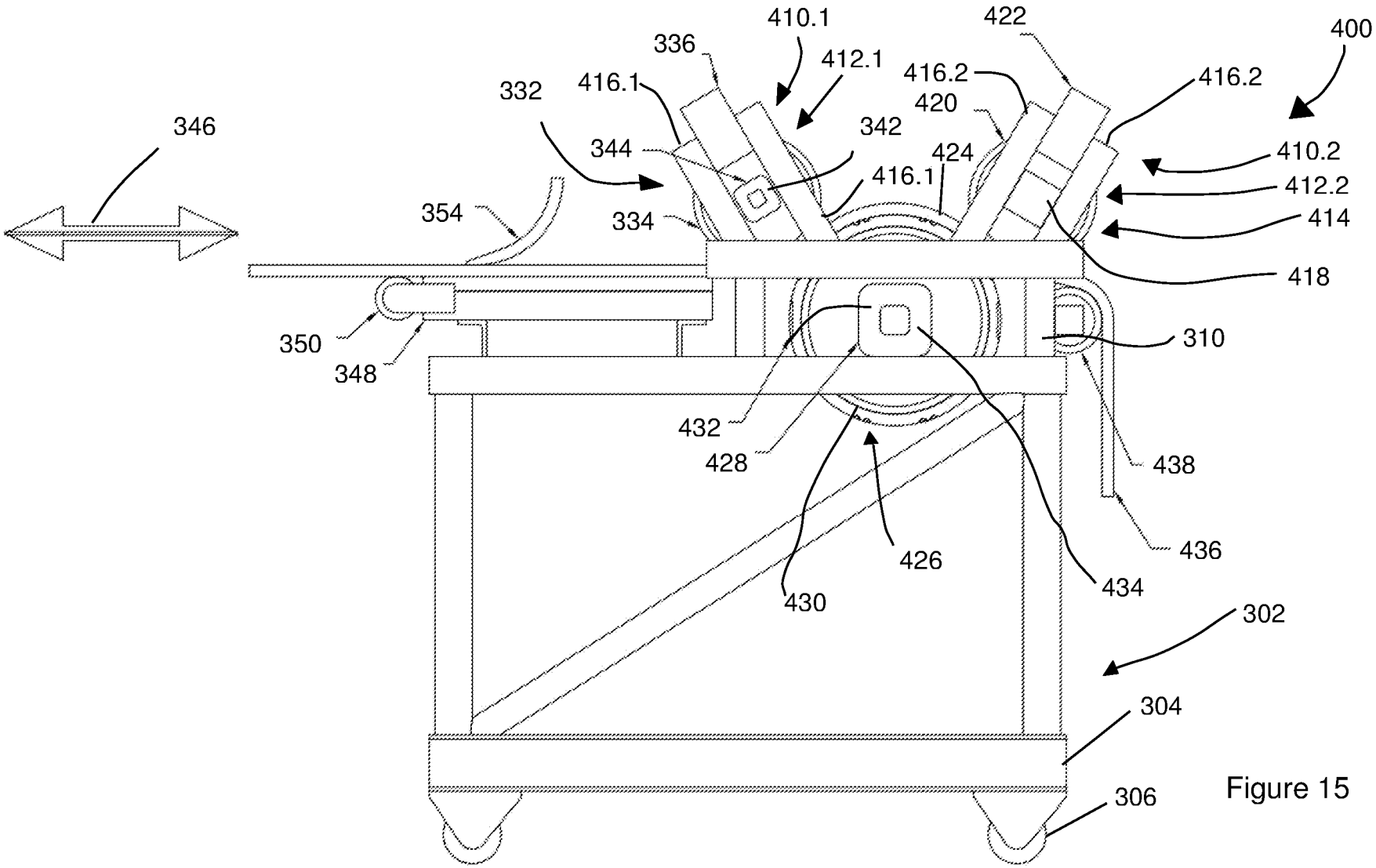
FIG. 15 shows a side view of an example of an accessory for a screening or separating apparatus.
Figure 16:
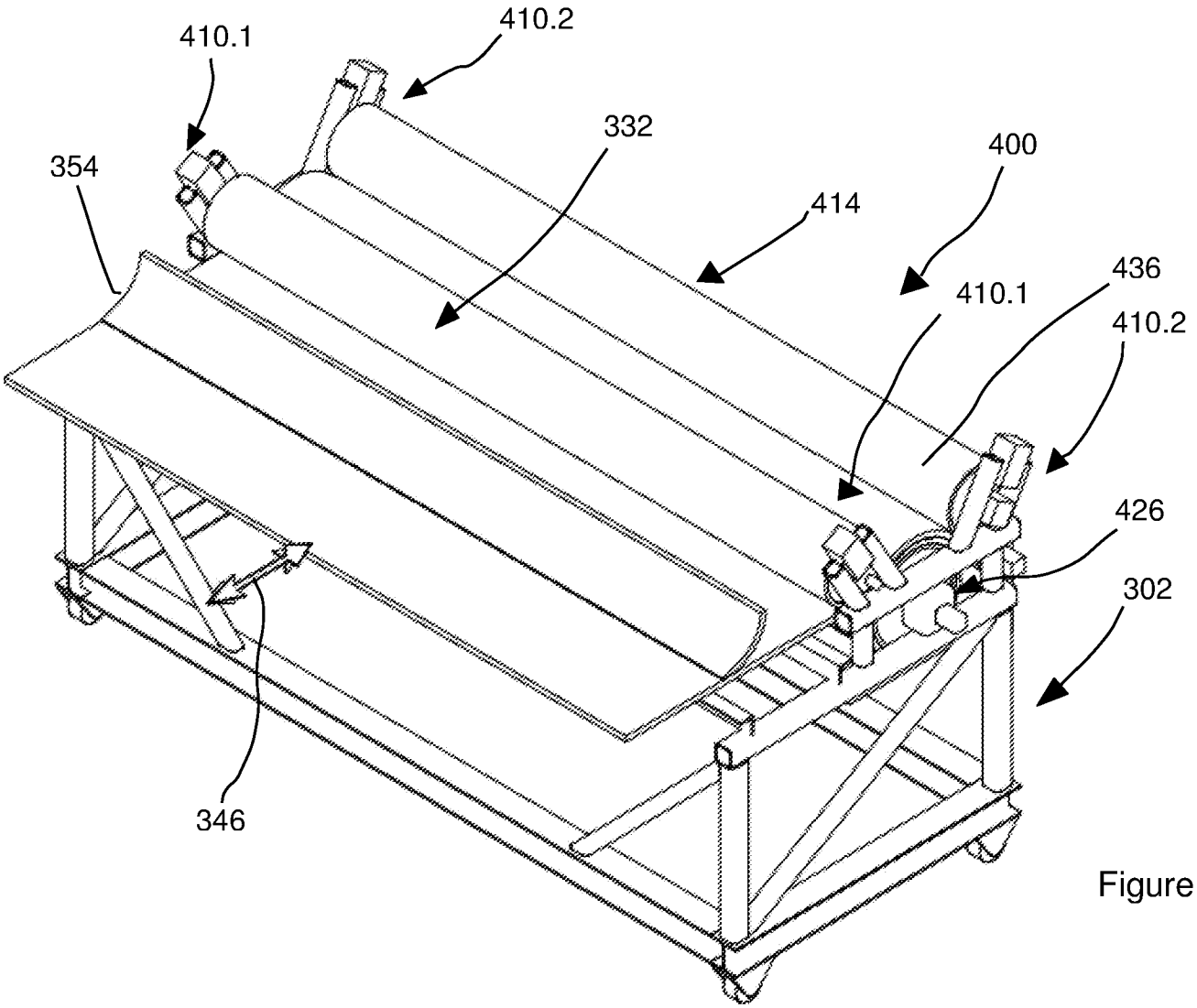
FIG. 16 shows a three-dimensional view, from above, of the accessory of FIG. 15.
Figure 17:
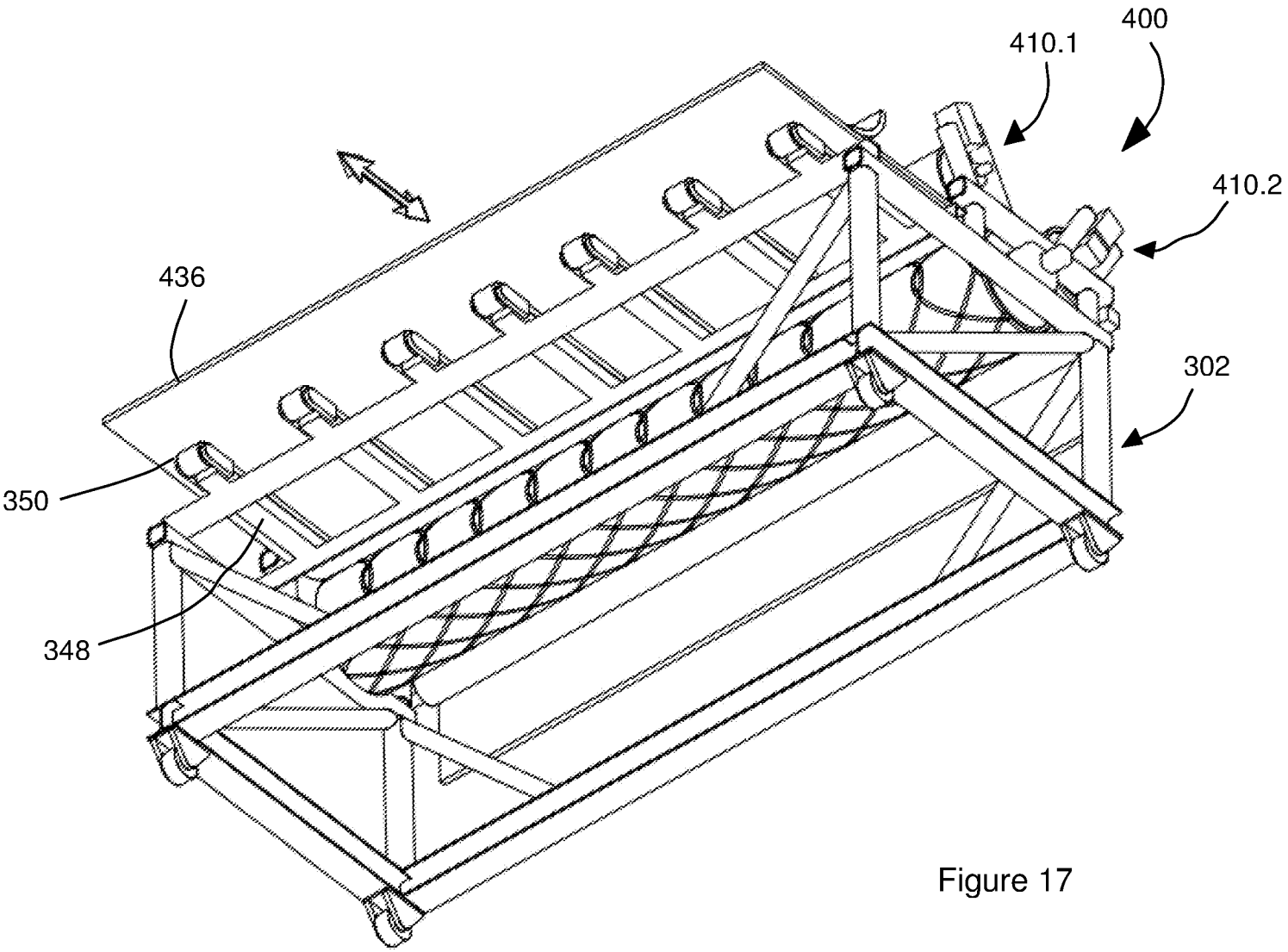
FIG. 17 shows a three-dimensional view, from below, of the accessory of FIG. 15.
Figure 18:
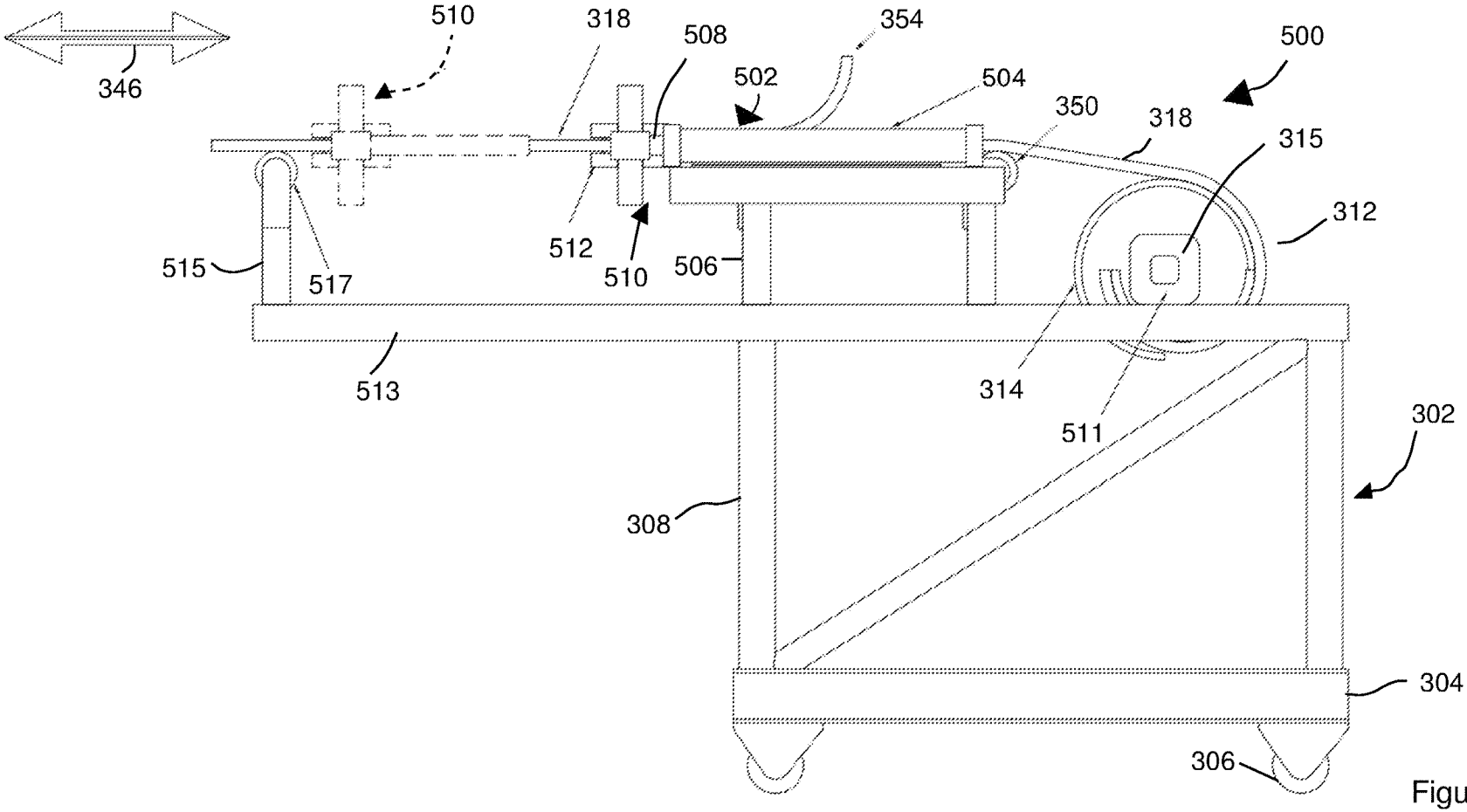
FIG. 18 shows a side view of an example of an accessory for a screening or separating apparatus.
Figure 19:
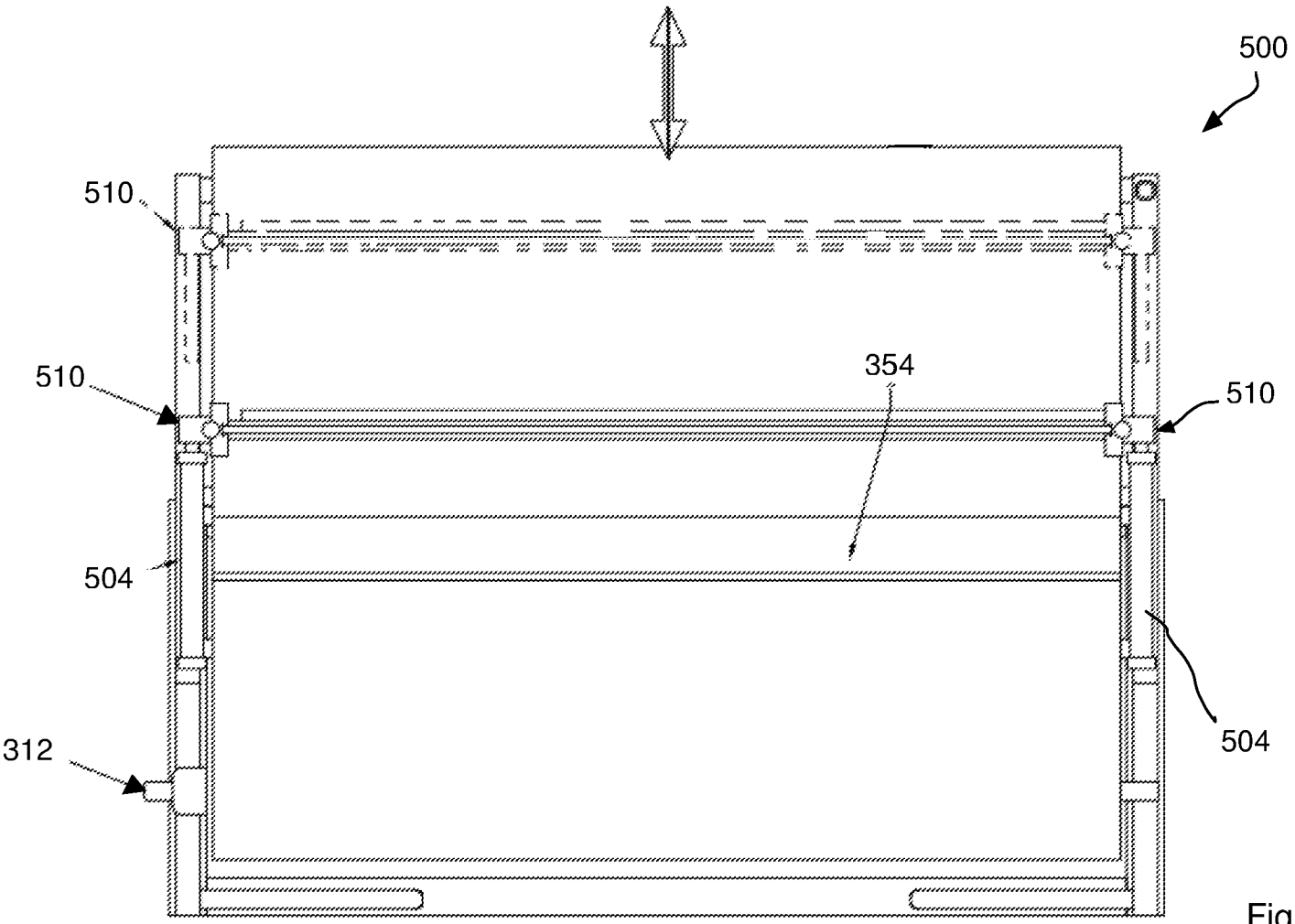
FIG. 19 shows a plan view, from above, of the accessory of FIG. 18.
Figure 20:
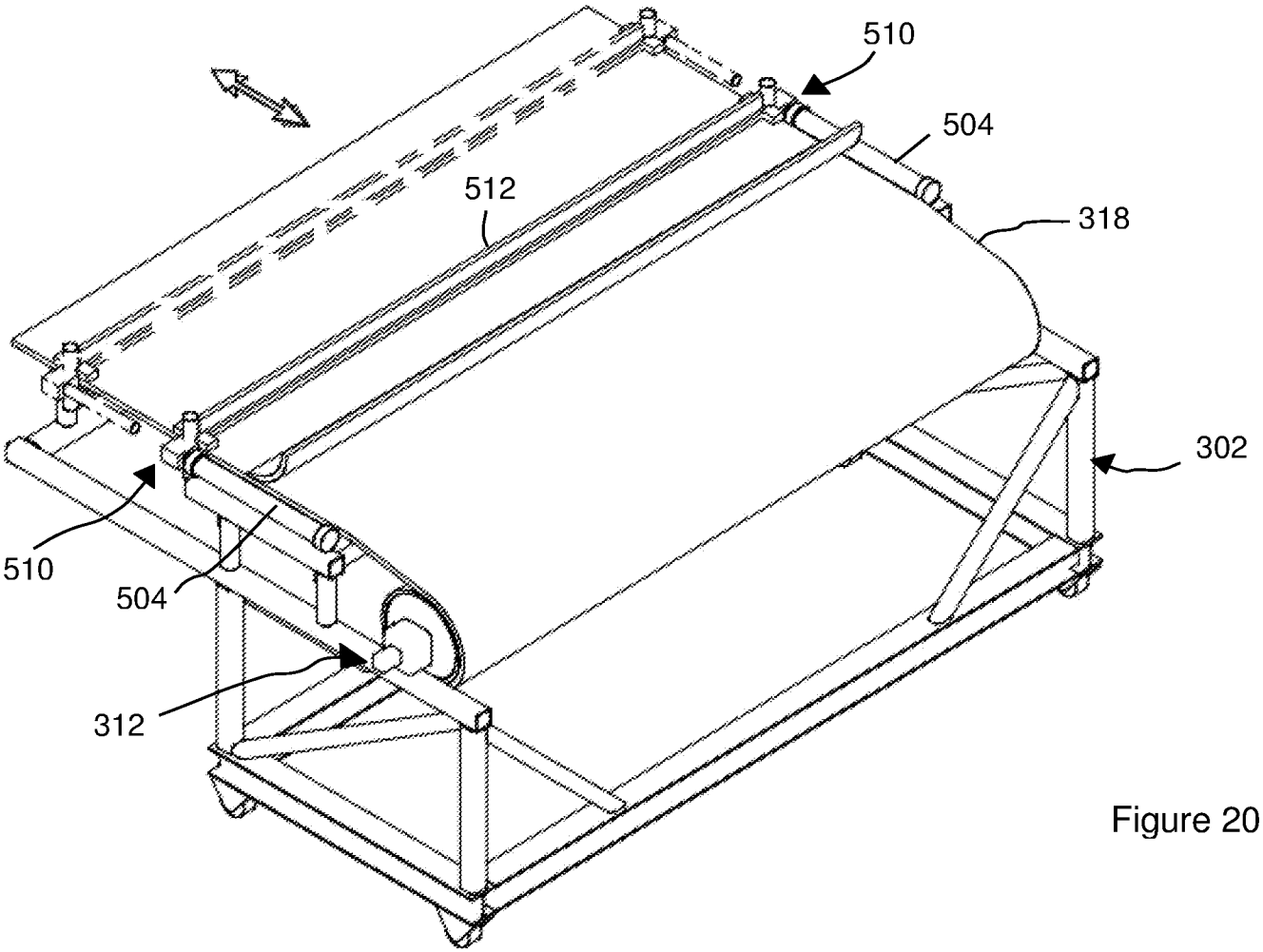
FIG. 20 shows a three-dimensional view, from above, of an example of an accessory for a screening or separating apparatus.
Figure 21:
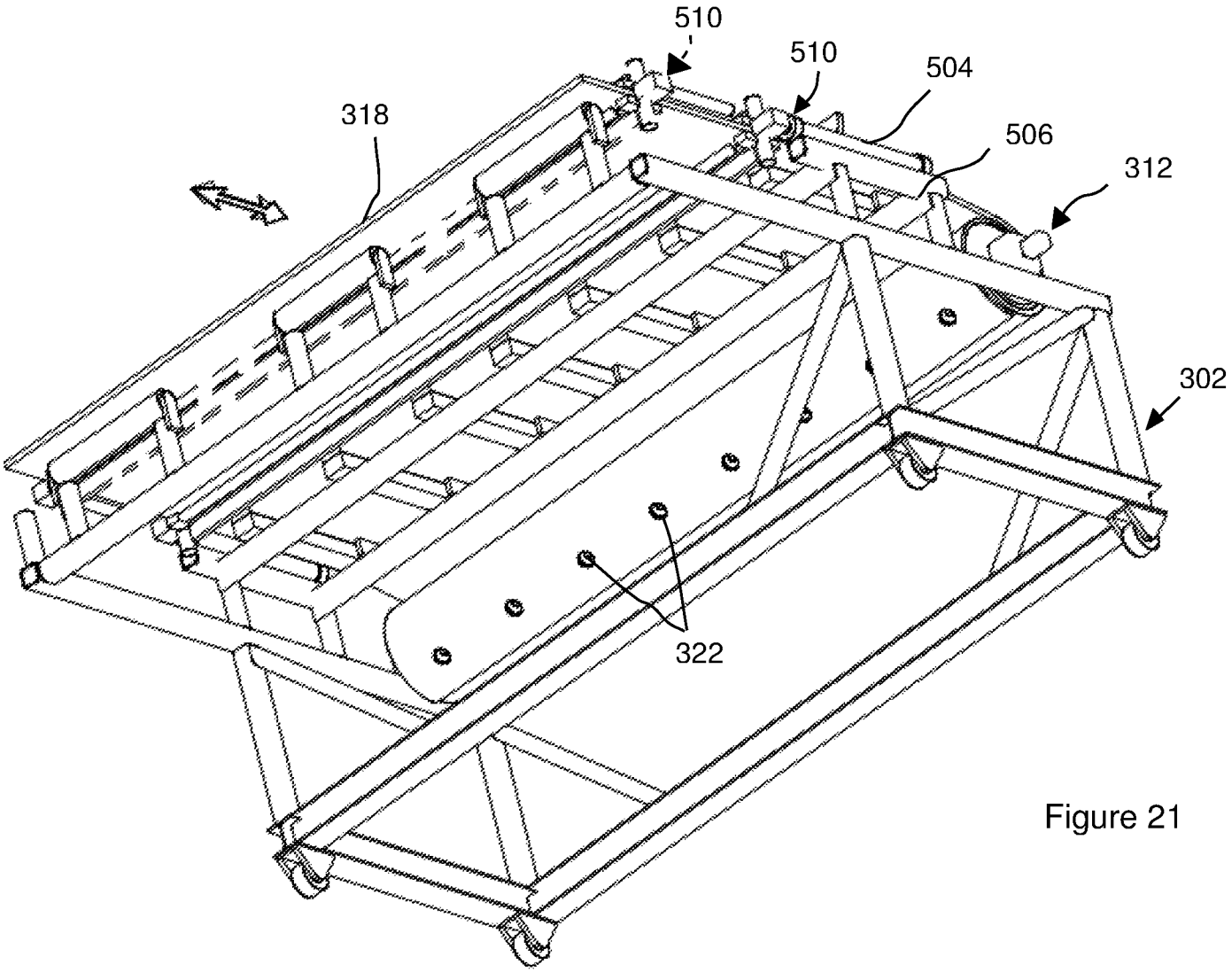
FIG. 21 shows a three-dimensional view, from below, of the accessory of FIG. 18.

In FIGS. 15 to 17, reference numeral 400 generally indicates an example of an accessory for use with a screening or separating apparatus.

The accessory 400 includes a drum roller assembly 426 that is mounted on the roller support structure 310. The drum roller assembly 426 includes a drum roller 430 that is rotatable with respect to a hub 428 that is mounted on the roller support structure 310. The drum roller assembly 426 includes a drive mechanism, for example, a rotary hydraulic drive 432 to rotate the drum roller 430. The hydraulic drive 432 can be actuated by a suitable controller such as a PLC or some other data processing device to be driven either clockwise or anticlockwise. The hub 428 incorporates a braking mechanism, generally indicated at 434, to brake the drum roller 430 against rotation. The braking mechanism 434 can also be actuated by the controller so that braking of the drum roller 430 can be selected or deselected, manually or automatically.

In this example, there are two guide arrangements 410, in the form of a forward guide arrangement 410.1 and a rear guide arrangement 410.2. Each of the guide arrangements 410 are similar to the guide arrangement 330.

The guide arrangement 410.1 is configured so that the drive roller assembly 332 is mounted above the drum roller assembly 426 to be displaceable towards and away from the drum roller 430. The position of the forward guide arrangement 410.1 is such that the axes of rotation of the drum roller 314 and the drive roller 334 are positioned in a plane that is angled forwardly with respect to the mat 318.

The guide arrangement 410.2 is configured to permit an idler roller assembly to be mounted above and rearwardly of the drum roller assembly 426 to be displaceable towards and away from the drum roller 430.

The guide arrangements 410.1 and 410.2 include two guide assemblies 412.1 and 412.2 mounted on respective sides of the roller support structure 310 so that the drive roller assembly 332 and the idler roller assembly 414 are mounted between respective guide assemblies 412.1 and 412.2. The guide assemblies 412 include respective pairs of guide rails 416.1 and 416.2. The guide rails 416.2 extend rearwardly from the roller support structure 310 while the guide rails 416.1 extend forwardly from the roller support structure 310.

The idler roller assembly 414 includes a hub 418 engaged with the guide rails 416.1 and an idler roller 420 rotatably mounted on the hub 418. A displacement drive mechanism 422 is engaged with the hub 418 to drive the idler roller 420 towards and away from the drum roller 430.

The accessory 400 includes a shield or shield member in the form of a mat 436. The mat 436 is configured to perform a similar function to that performed by the mat 318. However, the characteristics of the mat 436 make it more suitable for being interposed between the drum roller 430 and the drive roller 334, and the drum roller 430 and the idler roller 420, respectively, rather than being wound onto the drum roller 314.

Thus, when the drive and drum rollers 334, 430 are driven in opposite directions, simultaneously, the mat 436 can be driven forwards or backwards to define the adjustment mechanism described above.

A contact portion 424 of the mat 436, that makes contact with the drum roller 430, can extend from the drive roller 334 to the idler roller 420. A length of the contact portion 424 can be adjusted, to some extent, by appropriate displacement of one or both of the drive and idler rollers 334, 420. Thus, in cases where gripping of the mat 436 is necessary, the displacement mechanisms 336, 422 can be actuated to drive the drive and idler rollers 334, 420 towards the drum roller 314. Alternatively, in cases where the mat 436 is required to be released or a gripping pressure is to be reduced, the displacement mechanisms 336, 422 can be actuated to drive the drive and idler rollers 334, 420 away from the drum roller 314. This would be useful for releasing the mat 436, for example, for maintenance The accessory 400 is particularly suited for those cases in which the mat 436 is thicker and bulkier than the mat 318. In such cases, the mat 436 may not be able to be wound onto the drum roller 314, conveniently. In this case, the mat 436 extends rearwardly from the idler roller 420 and is supported on a further idler roller 438, away from the framework 308 simply to hang down under gravity.

In FIGS. 18 to 21, reference numeral 500 generally indicates an accessory for a screening apparatus.

In this example, the mat 318 is wound onto the drum roller 314 in the manner described above with reference to the accessory 300.

The mat 318 is displaced making use of a reciprocating linear drive mechanism 502. The linear drive mechanism 502 includes two hydraulic cylinders 504 mounted on a support frame 506, with the mat 318 extending between the hydraulic cylinders 504 and over the distal and proximal guide rollers 350, 352.

A piston 508 extends from each cylinder 504. The cylinder 504 is double acting to allow the piston 508 to be reciprocated. The cylinder 504 is connected to a suitable controller such as a PLC, see below with reference to FIG. 27, for example, or some other processing device so that the piston 508 can be extended or retracted manually or under the control of an automated system.

A clamping assembly 510 is arranged on the ends of the pistons 508. The clamp assembly 510 is operable to clamp the mat 318. The clamping assembly 510 includes two opposed, elongate clamp members 512 that extend from one side of the mat 318 to another side of the mat 318 with the mat 318 interposed between the clamp members 512. The clamping assembly 510 is capable of being actuated with the PLC or some other processing device. In use, the clamping assembly 510 is operable to clamp the mat 318, between the clamp members 512, prior to extension of the pistons 508, so extending the mat 318 as the drum roller 314 rotates to accommodate the extension of the mat 318. The clamping assembly 510 is also operable to release the mat 318 prior to retraction of the pistons 508 so that, after retraction, the clamping assembly 510 can be operable to clamp the respective side of the mat 318 to extend the mat 318 further when the piston 508 is extended again.

In this embodiment, provision needs to be made for the extent of travel of the pistons 508. Thus, the support frame 506 includes an extension 513 that carries a roller carriage 515 that extends upwardly from the extension 513. A guide roller 517 is mounted on the carriage 515 to support the mat 318 on a discharge side of the clamping assemblies 510 when the clamping assemblies 510 are extended. This facilitates transition of the belt or mat 318 from the accessory 500 to the deck of the screening apparatus.

The hub 315 incorporates a braking mechanism 511. The braking mechanism 511 is configured to retard or inhibit rotation of the drum roller 314 while the sides of the mat are released by the clamping assembly 510. The braking mechanism 511 is configured to be operated by a controller together with the clamping assemblies 510 so that the timing of operation of the braking mechanism 511 and the clamping assemblies 510 can be controlled to effect extension or retraction of the mat 318 to define the adjustment mechanism described above.

Figure 22:
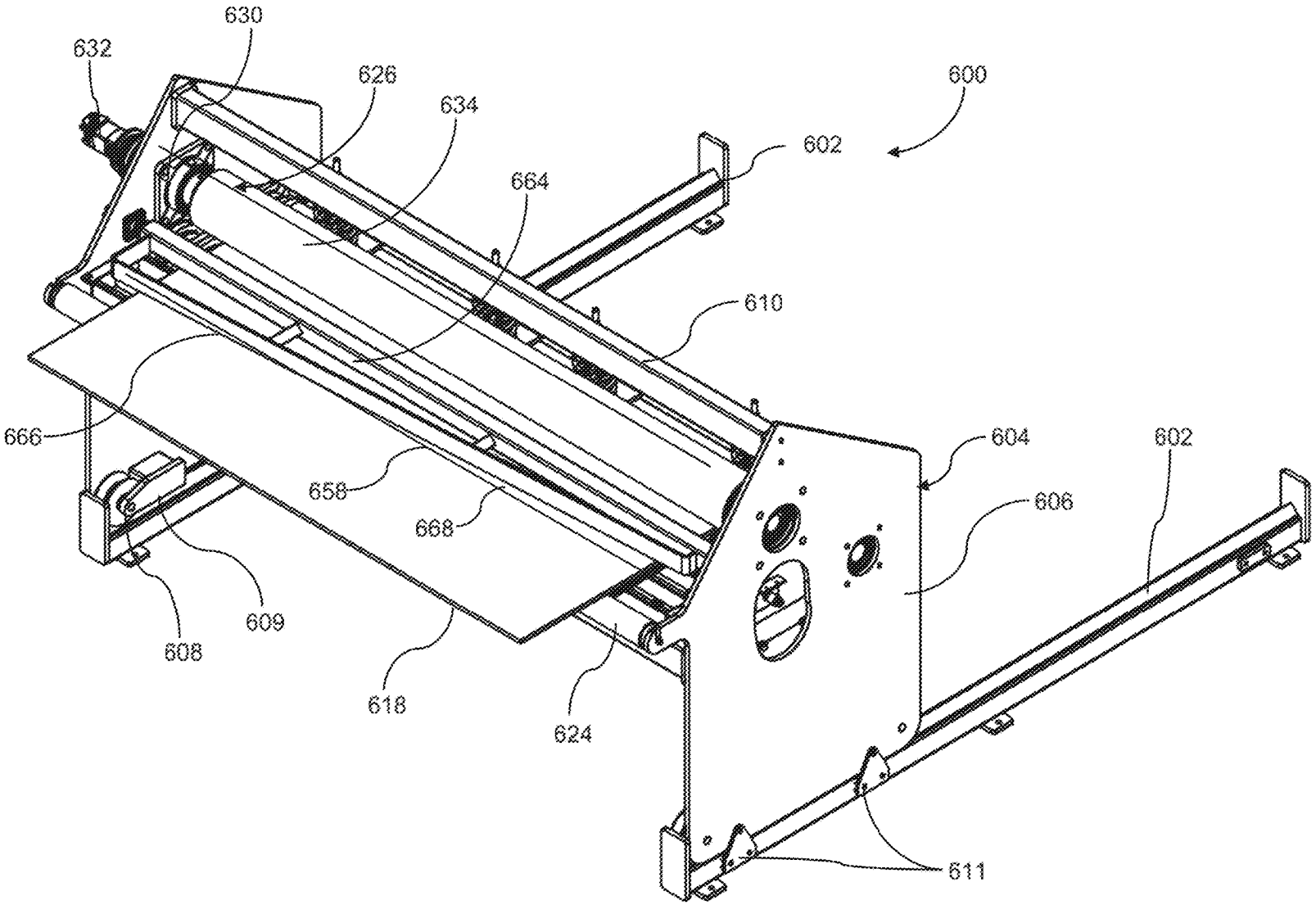
FIG. 22 shows a three-dimensional view, from above, of an example of an accessory for a screening or separating apparatus.
Figure 23:
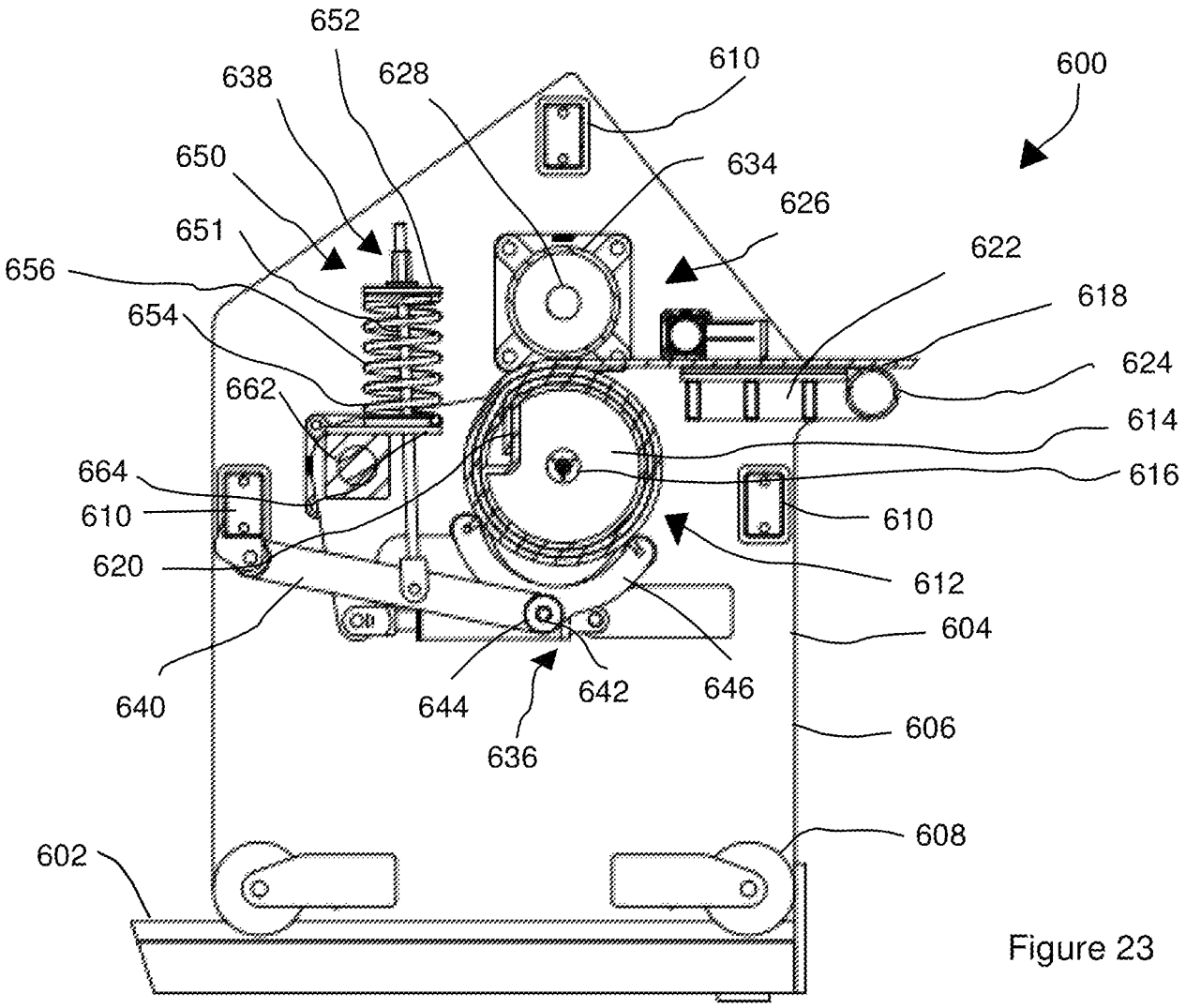
FIG. 23 shows a side view of the accessory of FIG. 22.
Figure 25:
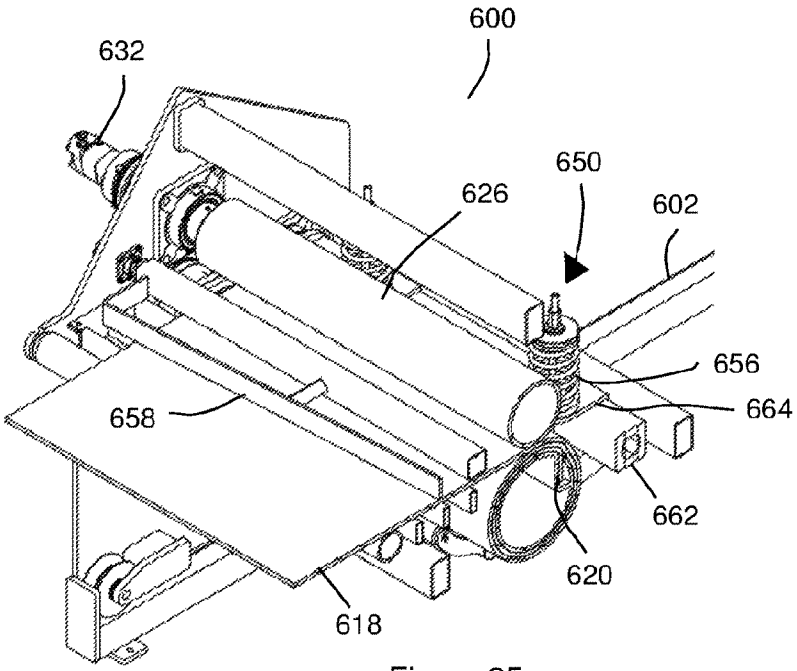
FIG. 25 shows a three-dimensional, cutaway view, from above, of the accessory of FIG. 22.
Figure 24:
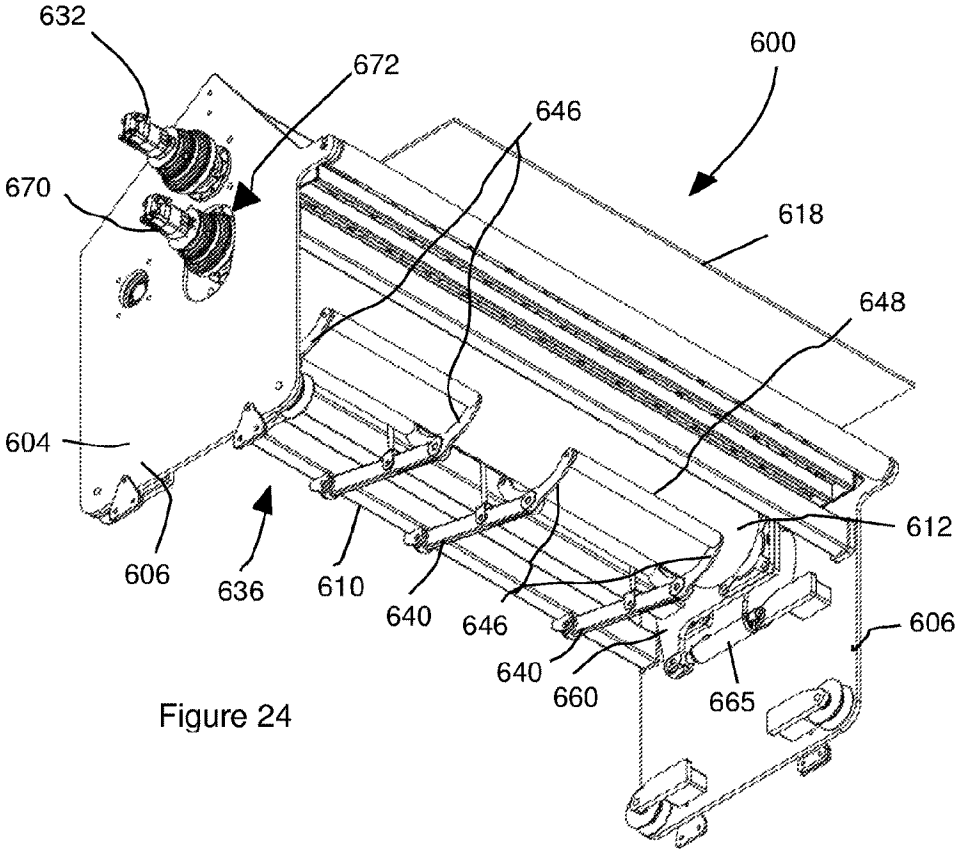
FIG. 24 shows a three-dimensional view, from below, of the accessory of FIG. 22.

In FIGS. 22 to 24, reference numeral 600 generally indicates an example of an accessory for use with a screening assembly.

The accessory 600 includes two spaced rails 602 capable of being fastened to a substrate or simply positioned on the substrate.

A wheeled support structure 604 is positioned on the rails 602 so that the support structure can be wheeled to and fro along the rails 602. The support structure 604 includes two support panels 606. Two wheels or casters 608 are mounted on a lower edge of each support panel 606 to engage respective rails 602. A braking or locking assembly 609 can be operatively associated with each caster 608 so that, once the structure 604 is in its operative position, the braking assemblies 609 can be used to lock the structure 604 in position.

A lockdown mechanism 611 can be used to lock the support structure 604 to the rails 602 once the support structure 604 is in its operative position. It will be appreciated that a significant amount of force can be exerted on the roller assemblies, via the mat, in use. The lockdown mechanism 611 can serve to inhibit the support structure 604 from tipping towards the deck.

A number of structural members interconnect the support panels 606. For example, three elongate structural members or beams 610 interconnect the support panels 606.

The roller assemblies include a drum roller assembly 612. The drum roller assembly 612 includes a drum roller 614 mounted on a shaft 616. One end 620 of a mat 618 is secured to the drum roller 614 so that rotation of the drum roller 614 can cause the mat 618 to wind onto or off the drum roller 614. The mat 618 performs a similar function to the mat 318. The mat 318 can be reciprocally displaced over guide rails 622 and an idler roller 624 to define the adjustment mechanism described above.

A hydraulic drive mechanism in the form of a hydraulic drive motor 670 is mounted on the shaft 616 to extend from a slotted opening 672 defined in one of the support panels 606

The roller assemblies also include a drive roller assembly 626. The drive roller assembly 626 includes a shaft 628 that is rotatably mounted between the support panels 606 with bearing assemblies 630. A drive roller 634 is fixed, coaxially, to the shaft 628. A drive mechanism in the form of a hydraulic drive 632 is mounted on one end of the shaft 628 to rotate the shaft 628 and thus the drive roller 634.

The drive roller 634 engages the drum roller assembly 612 such that rotation of the drive roller 634, when driven by the drive 632, causes the mat 618 to extend or retract depending on a direction of rotation of the drive roller 634.

The drive roller 634 bears against the mat 618 that is wound about the drum roller 614. Thus, as the mat 618 is wound onto the drum roller 614, a spacing between the drum roller 614 and the drive roller 634 must, of necessity, increase to accommodate the mat 618. Inversely, as the mat 618 is wound off the roller 614, a spacing between the roller 614 and the roller 634 must, of necessity, decrease so that the roller 634 can continue to bear against the mat 618 to drive the roller 614.

To accommodate this, the drum roller assembly 612 is displaceable relative to the support panels 606. This can be achieved in several ways, some examples of which have been described above with reference to the various embodiments of the accessory.

In this example, the drum roller 612 is mounted on a cradle assembly 636. The cradle assembly 636 is spring mounted on one of the beams 610 such that movement of the cradle assembly 636 away from the drive roller assembly 626 is against a bias of a spring mechanism 638.

The cradle assembly 636 includes four cradle arms 640 that are spaced apart and pivotally mounted on one of the support beams 610 to be pivotal in respective vertical planes. Four carriers 646 are mounted on free ends of respective cradle arms 640 with pivot pins 642 so that the carriers 646 are pivotal with respect to the respective cradle arms 640. Two carrier rollers 648 are rotatably mounted on the carriers 646 in a parallel, spaced apart configuration. The carrier rollers 648 are biased into engagement with the drum roller assembly 612 by the spring mechanism 638 so that the wound mat 618 bears against the carrier rollers 648. Thus, the carrier rollers 648 rotate to accommodate rotation of the drum roller assembly 612 while the spring mechanism 638 is configured to generate a required pressure between the drive roller 634 and the wound mat 618 to facilitate driving of the drum roller assembly 612 by the drive roller assembly 626.

The spring mechanism 638 includes a series of spring assemblies 650. Each spring assembly 650 includes a spring rod 651 pivotally mounted, at one end, to one respective cradle arm 640. Each spring assembly 650 includes an upper spring plate 652 and a lower spring plate 654. A coil spring 656 is interposed between respective pairs of plates 652, 654.

The shaft 616 is rotatably mounted on and between two support plates 660. Each support plate 660 is pivotally mounted on a respective support panel 606. Each support plate 660 is also fixed to a respective end of a tensioning bar 662. Four lugs 664 are mounted on the tensioning bar 662 to extend from the tensioning bar 662 to be positioned beneath respective lower spring plates 654. Each of the spring rods 651 extends through a respective lug 664. Each of the lower spring plates 654 is displaceable relative to the respective spring rod 651 towards and away from the upper spring plates 652. Thus, displacement of the lugs 664 and thus the lower spring plates 654 towards the upper spring plates 652 serves to compress the coil spring 656 so increasing the pressure between the wound mat 618 and the drive roller 634. Conversely, displacement of the lugs 664 and thus the lower spring plates 654 away from the upper spring plates 652 serves to extend the coil spring 656 so decreasing the pressure between the wound mat 618 and the drive roller 634.

A drive mechanism is engaged with each support plate 660 and is operable to pivot the support plate 660 and thus the tensioning bar 662 to adjust a tension within the coil springs 656. The drive mechanism can be in the form of a hydraulic cylinder and piston arrangement 665 mounted on one of the support panels 606.

A scraper 658 is mounted between the support panels 606. The scraper 658 includes a transverse bar 664 that extends between the support panels 606 and is pivotal with respect to those panels 606 so that the scraper 658 can be moved into and out of operative engagement with the mat 618.

A scraping member 666 is mounted on the bar 664. The scraping member 666 defines a guide surface 668 that is angled with respect to a direction of travel of the mat 618 to ensure that particulate material or aggregate is diverted off the mat 618 while the mat 618 is being retracted to inhibit damage to the roller assemblies.

Figure 26:
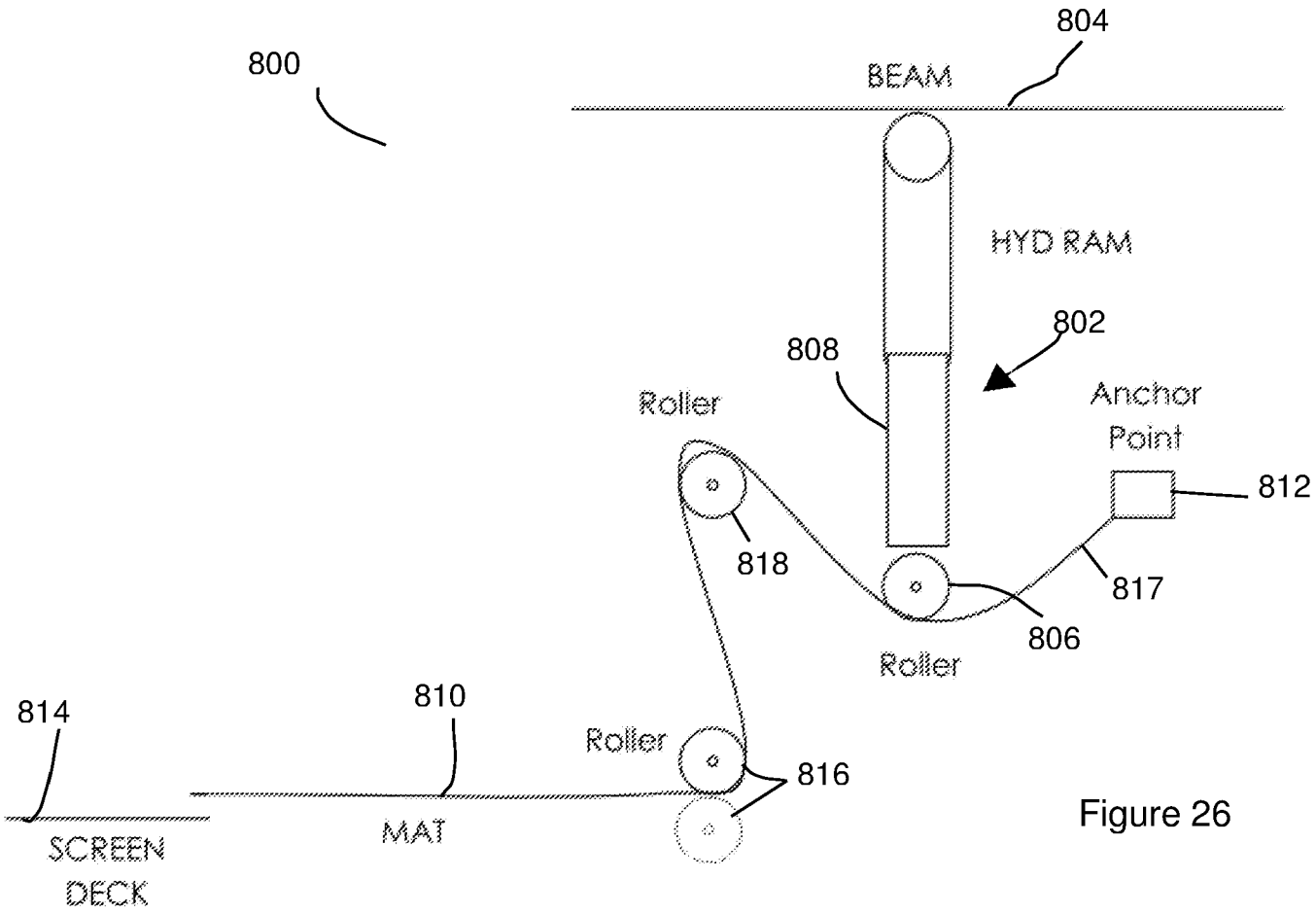
FIG. 26 shows a schematic drawing of another example of an accessory for a screening or separating apparatus.

In FIG. 26, reference numeral 800 generally indicates a schematic of a screening apparatus.

In this embodiment, a hydraulic ram mechanism 802 is suspended from a support structure 804. A roller 806 is rotatably mounted on an end of a piston 808 of the ram mechanism 802.

A mat 810 is fixed, at one end, to an anchor 812. A free end of the mat 810 is positioned on a screen deck 814. The mat 810 passes between a pair of driven rollers 816 which are operable to drive the free end of the mat 810 towards a discharge end of the deck 814. A proximal portion 817 of the mat 810 extends from the anchor 812 over the roller 806 and over a further roller 818. The roller 818 the anchor 812 are positioned so that when the roller 806 is driven downwardly by the piston 808, an effective length of the proximal portion 817 is increased, serving to retract the mat 810. When the piston 808 is retracted, the effective length of the proximal portion 817 is decreased and the rollers 816 serve to extend the mat 810 towards the discharge end of the deck 814. In this manner, the adjustment mechanism described above is defined.

In the following paragraphs, reference is made to the accessory and the various components thereof described with reference to FIGS. 12 to 25. The numerals have been omitted for the purposes of clarity only. Such omission should not be regarded as indicating that the components described below have no association with the embodiments of the accessory described above. Furthermore, the inventor (s) envisages that the accessory described below could also be in the form of the accessory described in the other figures, with minimal modification.

In use, the accessory is displaced, using the casters and rails, towards the feed end 307 of the deck 309 of a screening apparatus. The accessory finds particular application with multi-deck screening apparatus. Thus, the accessory is configured for use with a bottom deck of such an apparatus. In these cases, the accessory can be positioned within about 250 mm to 500 mm from a feed end of the deck. In those embodiments in which the accessory is mounted on rails, the rails could be arranged behind the screening apparatus to terminate about 500 mm from a feed end of the deck.

As is known, such screening apparatus have a curtain 313 (FIG. 12) of an elastomeric material, such as rubber, that depends from an upper deck to the bottom deck. The purpose of this curtain is to inhibit aggregate material from being rejected rearwardly from the deck. Particularly with generally horizontal decks, the vibrational pattern created by the vibrators is set up so that material naturally moves from the feed end to the discharge end of the decks. Thus, the mat will naturally be drawn towards the discharge end of the deck. This can be constrained, for example, by the braking mechanisms in the roller assemblies described above. For example, the mat can be released until a desired length of the mat is positioned on the deck. That length can be determined in a number of ways. For example, encoders are described below with reference to controlling the accessory. Otherwise, proximity detectors mounted on the deck can be used to detect the discharge end of the mat. In another example, a measuring wheel can be engaged with the mat to measure the extent of movement of the mat. The measuring wheel can be configured to generate a digital output for reading by, for example, the PLC described below.

When in position, the mat of the accessory can be pushed under the curtain 313 to lift the curtain as indicated by an arrow 315 in FIG. 12 and to bear against the bottom deck. The mat can then be extended along the bottom deck using any of the mechanisms described above. It will be appreciated that the vibrational pattern of the apparatus will serve to draw the mat out, as well. The accessory is configured so that the mat angles downwardly from the accessory onto the deck. This facilitates feeding of the mat onto the deck. An example of a suitable drop would be between about 50 mm and 100 mm.

Once in place, the mat of the accessory is retained to some degree on the deck 309. Thus, when the accessory is used, the step of pushing the mat under the curtain does not have to be repeated.

The corners of a leading edge of the mat can be clipped to stop the mat from catching. For example, the leading edge of the mat can define 45° mitres.

It will be appreciated that, when handling material such as aggregate from a quarry, the weight of the material can inhibit movement of the mat when the screening apparatus is inoperative, without damage to the hydraulic drive mechanisms. Thus, the accessory can include a manual winch mechanism that can be used to retract the mat.

In the various embodiments described above, the accessory is wheeled into and out of operative engagement with the screening apparatus. The inventor(s) envisages that the accessory can be brought into and out of operative engagement with the screening apparatus using other mechanisms. These could include swinging or pivoting the apparatus into position from a side of the screening apparatus. In that case, the accessory could be suspended. Alternatively, the accessory could have pivotal wheels allowing the accessory to be steered into position.

In the various embodiments described above, it is clear that gripping and displacing the mat is carried out by rollers. It follows that the rollers can have surfaces that are configured to facilitate such gripping. Thus, the rollers can have projections or other formations, such as teeth, that can impinge into the mat to enhance gripping. These projections or formations are selected so as not to damage the mat, especially the upper surface of the mat.

In the various embodiments described above, the hydraulic drives have been attached to the shafts of the rollers to drive the shafts. The inventor(s) envisages that various other arrangements may be used. Other drives such as internal combustion engines with gearboxes could be used instead of rotary hydraulic drives.

As can be seen above and in the drawings, in those cases where a pair of opposed rollers are used to drive the belt, those rollers can be offset. This can enhance a contact area between the mat and the rollers, so enhancing the ability of the rollers to displace the mat.

The various accessories described above can include a cover to protect the various mechanisms such as the roller assemblies from the ingress of rocks and stones and other detritus. The cover can also be configured to protect personnel operating around the accessories.

In a number of the embodiments described above, cameras have been described as being able to obtain video signals relating to the characteristics of in feed and outfeed of the aggregate or particulate material. The inventor(s) envisages that, in addition to cameras, or instead of cameras, other types of scanners could be used. For example, x-rays could be used to analyse the feeds. Another way of determining the rate of feed is to measure the power consumption of the drive mechanisms for the feeding arrangements. It will be appreciated that the greater the power consumption, the higher the feed rate.

The accessories described above can be incorporated into the screening apparatus to form part of the screening apparatus and supplied together with the screening apparatus.

In a number of the embodiments described above, the roller assemblies are described as being positioned on a support structure such as a framework.

In some instances, it may be desirable that the mat be completely released from the accessory. For example, if the mat becomes stuck under a load of particulate material during a break down or maintenance of the screening apparatus, it could be convenient simply to disengage the remainder of the accessory from the mat. Thus, the accessory could include a quick-release mechanism for releasing the mat from the drum roller. In a number of the accessories described above, the quick release mechanism can be provided by the linear drive mechanisms used to displace the drive and idler roller assemblies.

As described above, the position of the mat is related to the characteristics of the screenings and the discharge. Thus, the accessory can be used to alter or set the characteristics of the screenings and the discharge.

In particular, and with reference to the illustrative drawing in FIG. 11, the accessories are particularly useful for enhancing fines collection from a feed of aggregate using the principles of granular convection described above. As is clear from the description relating to FIG. 11, the accessories are useful for manually or automatically adjusting a position of the mat to achieve different fines proportions within screenings.

Figure 27:
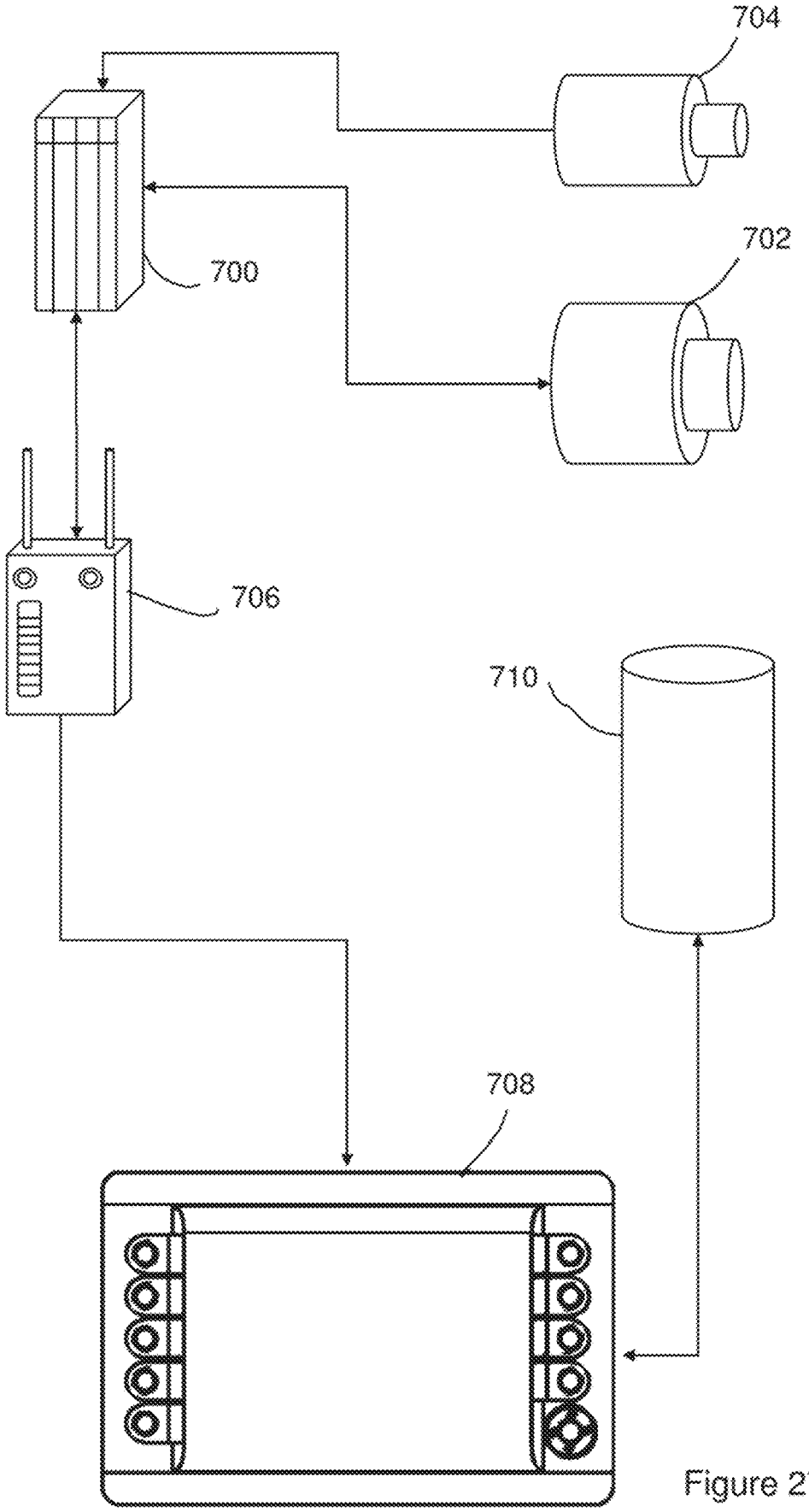
FIG. 27 shows a schematic layout of a control system for an accessory for a screening or separating apparatus.

FIG. 27 shows a schematic layout of various components that are used for controlling the position of the mat on the deck.

The accessory includes a PLC 700 that can be programmed as described below. The PLC 700 receives inputs from the rotary hydraulic drives described above and indicated at 702 for convenience. The PLC 700 also receives inputs from various encoders, indicated at 704, that are mounted on the rollers, or operatively arranged with respect to the rollers, to determine the extent of extension or retraction of the mat.

A modem 706 is connected to the PLC 700 to receive data relating to the operation of the various components.

A user interface 708 is configured to receive data from the modem 706.

A data storage device 710 is also connected to the user interface so that operational data can be stored for subsequent retrieval.

The user interface 708 is configured to provide an operator with visual feedback relating to the running condition of the various components of the accessory. The user interface 708 is configured so that the operator can make various selections and other adjustments to effect real-time operation. Together with the data storage device 710, which could be incorporated into the user interface 708, there is provided capability for data logging.

The modem 706 is configured to retrieve data logs from the data storage device 710 and to update the PLC 700 in order to alter operational characteristics. The modem 706 is also configured to diagnose faults that may be represented in the data received by the modem 706 and to report those faults to the user interface 708.

Various nodes can be used to bring inputs into the PLC 700. Such inputs could be in the form of signals relating to feed rate from the weightometers 19, 83. The feed rates could be represented by separate signals relating to infeed rate and outfeed rate received from the respective weightometers 19, 83.

Other inputs could include data relating to operation of a hydraulic circuit that is used to drive the hydraulic motors described above. Other data could relate to aspects of the hydraulic circuit and hydraulic motors such as system pressure, temperature and filter condition. Furthermore, the inputs could be used by the PLC 700 to control operation of the hydraulic motors using suitable feedback processes.

The user interface 708 can incorporate a touchscreen display with suitable screen layouts to provide information relating to, for example, infeed and outfeed rates based on data received from the weightometers, and mat position based on data received from the encoders.

The user interface 708 is configured to permit the input of data. The data input can relate to a desired mat position, a selection of manual or automatic operation, manual control of the mat position, and various other inputs that would facilitate operation of the accessory.

The components described above for control of the system are configured so that the accessory can operate in a manual mode or in an automatic mode. In the manual mode, the operator can directly control the position of the mat to extend or retract the mat as necessary. The user interface 708 and/or the PLC 700 can incorporate a safety feature that inhibits the mat from being adjusted without vibration of the deck. The reason for this is that there may be a significant weight of unscreened material positioned on the mat. In that situation, operation of the accessory could result in damage to the roller assemblies, particularly the drive mechanisms described above.

In automatic mode, the mat position is adjusted automatically to follow a preselected condition. For example, the PLC 700 can be programmed to adjust a position of the mat to achieve certain, desired screening and discharge characteristics. The PLC 700 can be programmed to define a control loop that is sufficiently damped to avoid constant movement of the mat and to facilitate overall average performance rather than targeting instantaneous accuracy. In this way, control of the accessory can be stable and not unduly disturbed by inconsistent infeed rate.

In use, the accessory can be controlled manually using the components described above and to generate information relating to a relationship between mat position, infeed rate, outfeed or discharge rate, and, if necessary, screenings characteristics, such as rate or composition. As has been described above, the variables need not be limited to rate. For example, with certain materials, the variables can be in the form of values related to composition of the screenings and discharge. In this way, the information can form a library that can be indexed and retrieved by the components when used in an automatic mode. For example, the user interface 708 can be used to select a desired discharge rate based on a predetermined infeed rate. The user interface 708 can access settings for the PLC 700 from the data storage device 710 so that the mat position can be automatically set without the need for manual adjustment.

The user interface 708 can be configured to log data received from the various components via the modem 706.

Figure 28:
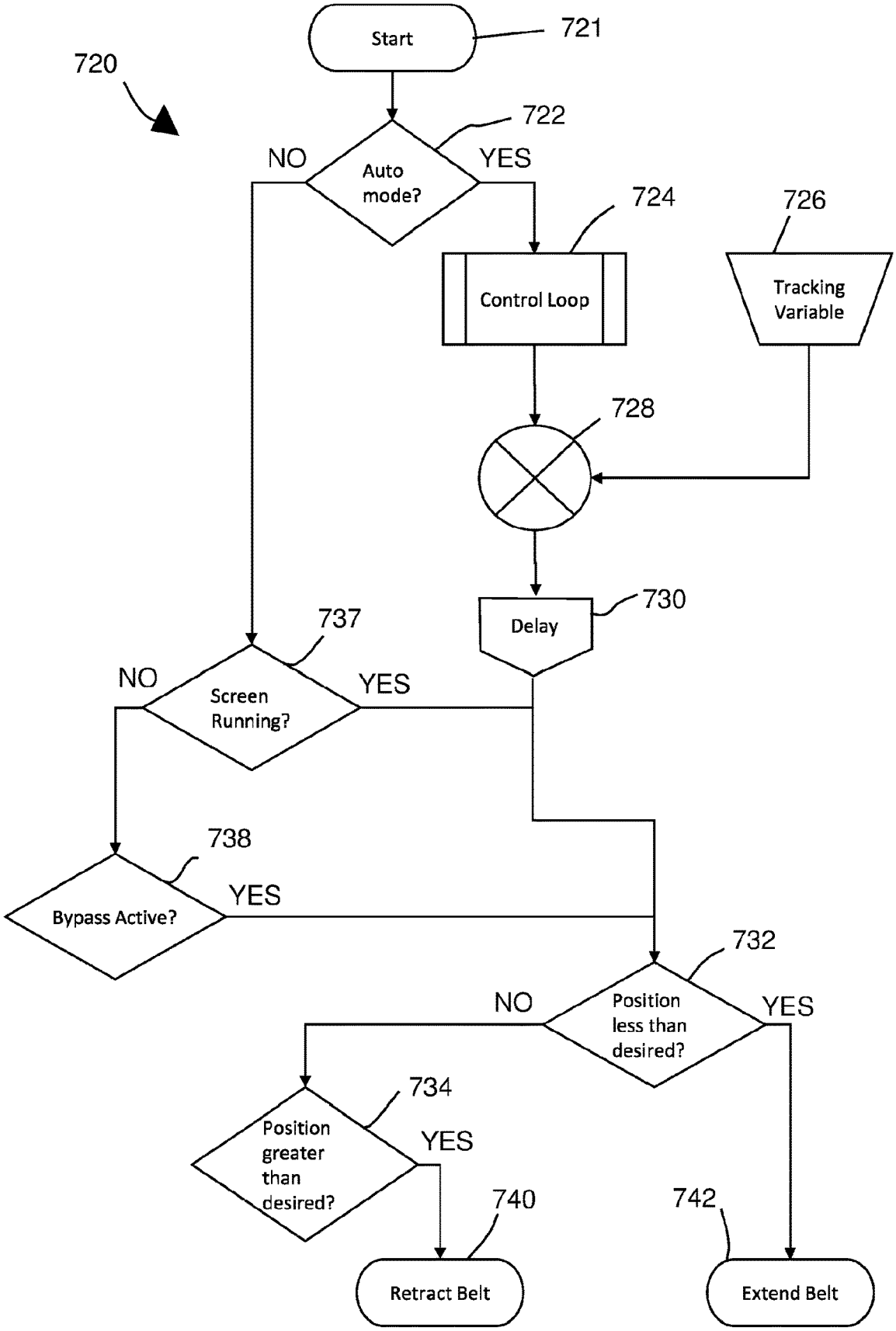
FIG. 28 shows a flowchart for programming a controller for an accessory for a screening or separating apparatus.

In FIG. 28, reference numeral 720 generally indicates a flowchart that could be used for programming a control system for controlling operation of the accessory and, more particularly, for positional control of the mat.

At 721, the process is started and at 722 the PLC 700 queries whether an automatic mode is operational.

If a result of the query is "yes", control passes to a control loop 724. At the control loop, a tracking variable 726 is introduced to a summing junction 728. The tracking variable could be infeed rate, outfeed rate, or any other variable described above that could be used to assess whether the mat should be extended or retracted.

It will be appreciated that it would be undesirable for the mat to respond immediately to feedback. Apart from the problems associated with lack of damping, the operational characteristics of the screening apparatus may require that a certain condition needs to be maintained for a length of time before a feedback signal can be regarded as accurate. For example, in a quarry, the material being fed onto the shield or screen usually does not have consistent characteristics. Thus, the rate can fluctuate.

In order to address this, the PLC 700 is programmed to execute a delay at 730. At 732, the PLC 700 runs a query as to whether a position of the mat is less than desired. If "yes", the PLC 700 signals an appropriate hydraulic motor(s) to operate so as to extend the mat at 742. If "no" the PLC 700 queries, at 734, as to whether a position of the mat is greater than desired. If "yes" the PLC 700 signals an appropriate hydraulic motor(s) to operate so as to retract the mat at 740.

At 722, if "no", the PLC 700 queries, at 736, as to whether the screening apparatus is operating. If "yes", the process moves to the query at 732. If "no", the PLC 700 queries, at 737, whether the screen is running. If "yes", control passes to 732. If "no" the PLC 700 queries, at 738, whether a bypass is active. If "yes", the process moves to the query at 732.

Experimental work was carried out to test the principles described above. A flexible mat or shield, comprised of conveyor belting, was cut to fit a vibrating screen surface. The mat was found to work in two ways on aggregate or particulate material positioned on the mat. The mat reduced the available open area on the screen, so decreasing a rate of passage of fine sized particles or fines through the screen. The mat also provided time for the fines within the aggregate to form a layer, as a result of granular convection or stratification, facilitating the classification of those fines as they are discharged from an end of the mat.

To summarise, the hypothesis tested by the experimental work was that a reduced open area on a screen would modify the size distributions of the oversized and undersized products, so providing greater control of product specifications to meet different market requirements. This would occur through a combination of a reduced screening time and an increased stratification effect.

During screening, particles are presented to the screen surface and given an opportunity to pass through apertures into an undersized stream. Particles larger than the screen apertures have zero probability to pass into the undersized stream. Particles smaller than the apertures have a probability of between zero and one, depending on the prevailing screen conditions.

In general, the probability of the smaller-than-apertures sized particles to pass into the undersized stream will decrease as the available open area decreases. However, all particles, large and small, compete for the opportunity to be presented to the open area. If part of the screen surface is covered, the feed materials will stratify as they travel along the length of the screen that is closed. The extent of stratification depends on the length of travel, among other variables such as vibration, slope, et cetera.

It follows that the degree of stratification will increase as a percentage of screen coverage is increased. This results in finer particles concentrating closer to the screen surface, separating more effectively when presented to the screen open area.

To simplify the analysis in the experiments, the percentage of sub-screen material in the feed reporting to the undersized product was used as the criteria for defining screening efficiency.

The following tables provide a summary of results. Two markers were selected to represent the content of fines in of over-sized (O/S) and under-sized (U/S) products. These were the −2.36 mm and the −0.6 mm size fractions.

In the table below, the screen length was 4290 mm.

| Test no. | Screen Aperture (mm) | Feed tonnes per hour | Feed Rate Class | Length of open area (mm) | Screen coverage (%) | Product | Tonnes per hour | % to product | %−2.35 mm | %−0.6 mm |
|---|---|---|---|---|---|---|---|---|---|---|
| 1 | 7.1 | 63.1 | Low | 4290 | 0 | U/S | 25.2 | 39.9 | 58.0 | 26.8 |
| | | | | | | O/S | 37.9 | 60.1 | 3.1 | 2.6 |
| 2 | 7.1 | 62.2 | Low | 2145 | 50 | U/S | 24.4 | 39.2 | 58.1 | 26.3 |
| | | | | | | O/S | 37.8 | 60.8 | 3.7 | 3.3 |
| 3 | 7.1 | 63.0 | Low | 1073 | 75 | U/S | 22.0 | 34.8 | 66.2 | 30.1 |
| | | | | | | O/S | 41.1 | 65.2 | 4.9 | 4.1 |

In the table below, the screen length was 3400 mm.

| Test no. | Screen Aperture (mm) | Feed tonnes per hour | Feed Rate Class | Length of open area (mm) | Screen coverage (%) | Product | Tonnes per hour | % to product | %−2.36 mm | %−0.6 mm |
|---|---|---|---|---|---|---|---|---|---|---|
| 4 | 22.5 | 69.6 | Low | 598.4 | 82.4 | U/S | 64.5 | 92.7 | 34.2 | 15.0 |
| | | | | | | O/S | 5.1 | 7.3 | 2.0 | 2.0 |
| 5 | 22.5 | 69.7 | Low | 302.6 | 91.1 | U/S | 55.0 | 78.9 | 31.3 | 17.5 |
| | | | | | | O/S | 14.7 | 21.1 | 3.1 | 3.0 |
| 6 | 22.5 | 72.1 | Low | 149.6 | 95.6 | U/S | 44.0 | 61.0 | 48.7 | 22.2 |
| | | | | | | O/S | 28.1 | 39.0 | 7.5 | 6.0 |

In the table below, the screen length was 4280 mm

| Test no. | Screen Aperture (mm) | Feed tonnes per hour | Feed Rate Class | Length of open area (mm) | Screen coverage (%) | Product | Tonnes per hour | % to product | %−2.36 mm | %−0.6 mm |
|---|---|---|---|---|---|---|---|---|---|---|
| 7 | 14 | 80.3 | Low | 4290.0 | 0.0 | U/S | 57.0 | 71.0 | 37.8 | 17.3 |
| | | | | | | O/S | 23.3 | 29.0 | 3.0 | 3.0 |
| 8 | 14 | 78.5 | Low | 2145.0 | 50.0 | U/S | 48.1 | 61.2 | 33.6 | 15.4 |
| | | | | | | O/S | 30.4 | 38.8 | 2.7 | 2.7 |
| 9 | 14 | 76.8 | Low | 1072.5 | 75.0 | U/S | 44.8 | 58.4 | 42.2 | 19.0 |
| | | | | | | O/S | 31.9 | 41.6 | 5.1 | 3.9 |
| 10 | 14 | 87.6 | Low | 429.0 | 90.0 | U/S | 37.9 | 43.2 | 47.6 | 21.8 |
| | | | | | | O/S | 49.8 | 56.8 | 12.2 | 7.4 |
| 11 | 14 | 122.4 | High | 4290.0 | 0.0 | U/S | 75.1 | 61.4 | 40.2 | 17.7 |
| | | | | | | O/S | 47.3 | 38.6 | 3.3 | 3.3 |
| 12 | 14 | 125.3 | High | 1072.5 | 75.0 | U/S | 50.9 | 40.7 | 43.5 | 19.5 |
| | | | | | | O/S | 74.3 | 59.3 | 9.4 | 7.1 |
| 13 | 14 | 121.5 | High | 429.0 | 90.0 | U/S | 38.6 | 31.8 | 49.9 | 21.9 |
| | | | | | | O/S | 82.9 | 68.2 | 10.5 | 7.5 |

Several conclusions arose as a result of the test. These included the conclusion that the flexible mat can be used to control screen product size The appended claims are to be considered as incorporated into the above description.

In the above description, like reference numerals refer to like parts, unless otherwise specified. The use of common reference numerals is not to be regarded as an indication that any components of one embodiment are essential for another embodiment and is for convenience only.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Words indicating direction or orientation, such as "front", "rear", "back", etc., are used for convenience. The inventor (s) envisages that various embodiments can be used in a non-operative configuration, such as when presented for sale. Thus, such words are to be regarded as illustrative in nature, and not as restrictive.

The invention claimed is:

1. A screening apparatus that comprises a vibrating screen assembly that includes a screen and a vibrating mechanism operable on the screen to cause vibration of the screen, the screen having a feed end and a discharge end;

at least one shield member, in the form of a mat, positioned on the screen so that vibration of the screen is imparted to the, or each, mat the, or each, mat covering part of the screen between the feed end of the screen and a position intermediate the feed and discharge ends of the screen, such that particulate material for screening by the screen can be fed on to the, or each, mat; and an adjustment mechanism engaged with the, or each, mat to adjust a position of a discharge end of the, or each, mat relative to the discharge end of the screen, the adjustment mechanism including a support structure and a roller assembly mounted on the support structure and engaged with opposite sides of the, or each, mat so that operation of the roller assembly results in displacement of the, or each, mat, the roller assembly being configured so that the, or each, mat can be extended or retracted by the roller assembly.

2. The screening apparatus of claim 1, wherein the, or each, mat is configured so the vibration of the mat is imparted to a layer of the particulate material on the, or each, mat to encourage stratification of the particulate material prior to the particulate material being fed onto the screen from the discharge end of the, or each, mat.

3. The screening apparatus as claimed in claim 1, wherein the, or each, mat is articulated and includes lengths of shield sections that are pivotal with respect to each other.

4. The screening apparatus as claimed in claim 1, wherein the, or each, mat is of an elastomeric material.

5. The screening apparatus as claimed in claim 1, wherein the roller assembly includes opposed rollers that engage, respectively, the opposite sides of the, or each, mat, at least one of the rollers being a driven roller.

6. The screening apparatus as claimed in claim 1, which includes a control arrangement that controls the adjustment mechanism.

7. The screening apparatus as claimed in claim 6, in which the control arrangement is configured to permit direct control of an extent of adjustment of the relative positions of the discharge ends of the, or each, mat and screen, respectively.

8. The screening apparatus as claimed in claim 6, wherein the control arrangement includes an infeed sensing arrangement for sensing an infeed rate of particulate material onto the, or each, mat and an outfeed sensing arrangement for sensing at least one of an outfeed rate of screenings and an outfeed rate of discharge from the screen.

9. The screening apparatus as claimed in claim 8, in which the control arrangement includes a data processing apparatus that is configured to receive signals from the sensing arrangements and to generate suitable output signals for the adjustment mechanism so that the adjustment mechanism can be controlled automatically to adjust a particle size distribution of at least one of the discharge and the screenings.

10. The screening apparatus as claimed in claim 8, wherein the sensing arrangements include weigh-in-motion devices, one of which is positioned upstream of the screen and at least one other positioned to receive either the discharge or the screenings.

11. The screening apparatus as claimed in claim 8, wherein the sensing arrangements include at least one sensor that is operatively arranged with respect to the screen to sense at least one of particle size distribution within particulate material fed to the, or each, mat, particle size distribution within screenings and particle size distribution within discharge.

12. The screening apparatus as claimed in claim 1, wherein the screen has apertures which are all generally of the same size.

13. The screening apparatus as claimed in claim 1, wherein the screen has different zones between the feed end and the discharge end of the screen, each zone having apertures of a different size to the apertures of an adjacent zone.

14. An accessory for a screening apparatus, the accessory comprising:

at least one shield member, in the form of a mat, that is configured so that part of the, or each, mat can be positioned on a vibrating screen of the screening apparatus, so that vibration of the screen is imparted to the, or each, mat, the, or each, mat covering part of the screen between a feed end of the screen and a position intermediate the feed end and a discharge end of the screen such that particulate material for screening by the screen can be fed onto the, or each, mat; and an adjustment mechanism engaged with the, or each, mat to adjust a position of a discharge end of the, or each, mat relative to the discharge end of the screen, the adjustment mechanism including a support structure and a roller assembly mounted on the support structure and engaged with opposite sides of the, or each, mat so that operation of the roller assembly results in displacement of the, or each, mat, the roller assembly being configured so that the, or each, mat can be extended or retracted by the roller assembly.

15. The accessory as claimed in claim 14, wherein the, or each, mat is configured so that vibration of the mat is imparted to a layer of the particulate material on the, or each, mat to encourage stratification of the particulate material prior to the particulate material being fed onto the screen from the discharge end of the, or each, mat.

16. The accessory as claimed in claim 14, wherein the mat is articulated and includes lengths of mat sections that are pivotal with respect to each other.

17. The accessory as claimed in claim 14, wherein the, or each, mat is of an elastomeric material.

18. The accessory as claimed in claim 14, wherein the support structure is configured for displacement towards and away from a deck of a screening apparatus.

19. The accessory as claimed in claim 18, wherein casters are mounted on the support structure and configured for engagement with a pair of rails so that the support structure can be reciprocally displaced along the rails.

20. The accessory as claimed in claim 14, wherein the roller assembly includes a drum roller onto which the, or each, mat is wound and a drive roller that is linearly displaceable towards and away from the drum roller so that the drive roller can bear against the, or each, mat and can be adjusted to accommodate effective increases and decreases in diameter of the drum roller as the mat is wound onto and off the drum roller, respectively.

21. The accessory as claimed in claim 20, wherein at least the drive roller is a driven roller and incorporates a drive mechanism that is configured for control by a data processing apparatus such that an extent of retraction or extension of the, or each, mat can be controlled by the data processing apparatus.

22. The accessory as claimed in claim 14, wherein the roller assembly includes a drum roller, a drive roller that is linearly displaceable towards and away from the drum roller and an idler roller that is also linearly displaceable towards and away from the drum roller, the drum roller being positioned beneath the, or each, mat and the drive and idler rollers being positioned above the, or each, mat and spaced from each other such that a length of the, or each, mat extends from a position between the drive roller and the drum roller and another position between the idler roller and the drum roller.

23. The accessory as claimed in claim 22, wherein at least the drive roller is a driven roller and incorporates a drive mechanism that is configured for control by a data processing apparatus such that an extent of retraction or extension of the, or each, mat can be controlled by the data processing apparatus.

24. The accessory as claimed in claim 14, wherein the roller assembly includes a drum roller onto which the, or each, mat is wound, a linearly reciprocal clamping mechanism being engageable with the, or each, mat on a discharge side of the drum roller, the clamping mechanism being linearly reciprocal towards and away from the drum roller to extend and retract the, or each, mat.

25. The accessory as claimed in claim 24, wherein the clamping mechanism is mounted on a piston of a hydraulic piston and cylinder arrangement that is operable to displace the clamping mechanism, reciprocally, the clamping mechanism being operable to open before the piston is retracted and to clamp onto the, or each, mat before the piston is extended, both the hydraulic piston and cylinder arrangement and the clamping mechanism being configured for control by a data processing apparatus such that an extent of retraction or extension of the, or each, mat can be controlled by the data processing apparatus.

26. The accessory as claimed in claim 25, wherein the drum roller incorporates a braking mechanism that is operable when the clamping mechanism is opened to retain the, or each, mat in position during retraction of the piston.

27. The accessory as claimed in claim 14, which includes a control arrangement that controls the adjustment mechanism.

28. The accessory as claimed in claim 27, wherein the control arrangement is configured to permit direct control of an extent of adjustment of the relative positions of the discharge ends of the, or each, mat and screen, respectively.

29. The accessory as claimed in claim 27, wherein the control arrangement includes an infeed sensing arrangement for sensing an infeed rate of particulate material onto the, or each, mat and an outfeed sensing arrangement for sensing at least one of an outfeed rate of screenings and an outfeed rate of discharge from the screen.

30. The screening apparatus as claimed in claim 29, wherein the control arrangement includes a data processing apparatus that is configured to receive signals from the sensing arrangements and to generate suitable output signals for the adjustment mechanism so that the adjustment mechanism can be controlled automatically to adjust a particle size distribution of at least one of the discharge and the screenings.

31. The screening apparatus as claimed in claim 29, wherein the sensing arrangements include weigh-in-motion devices, one of which can be positioned upstream of the screen and at least one other can be positioned to receive either the discharge or the screenings.

32. The screening apparatus as claimed in claim 29, wherein the sensing arrangements include at least one sensor that can be operatively arranged with respect to the screen to sense at least one of particle size distribution within particulate material fed to the, or each, mat, particle size distribution within screenings and particle size distribution within discharge.

33. A method of screening a particulate material, the method comprising the steps of feeding the particulate material on to at least one shield member, in the form of a mat, that is positioned on a screen of a vibrating screen assembly, the screen having a feed end and a discharge end, the, or each, mat covering part of the screen between the feed end of the screen and a position intermediate the feed and discharge ends of the screen so that vibration of the screen is imparted to the, or each, mat; and adjusting a position of a discharge end of the, or each, mat relative to the discharge end of the screen according to a desired particle size distribution of at least one of screenings and discharge, with an adjustment mechanism engaged with the, or each, mat, the adjustment mechanism including a support structure and a roller assembly mounted on the support structure and engaged with opposite ends of the, or each, mat so that operation of the roller assembly results in displacement of the, or each, mat, the roller assembly being configured so that the, or each, mat can be extended or retracted by the roller assembly.

34. The method as claimed in claim 33, which includes the steps of:

sensing an infeed rate of the particulate material onto the, or each, mat and an outfeed rate of at least one of screenings and discharge from the screen;

generating outputs carrying information relating to the infeed and outfeed rates; and carrying out the step of adjusting a position of the discharge end of the, or each, mat in response to inputs carrying the information and received by a data processing apparatus.

35. The method as claimed in claim 34, in which the step of adjusting the position of the, or each, mat is carried out by the data processing apparatus.

* * * * *